US010200781B2

(12) United States Patent
Yoo et al.

(10) Patent No.: US 10,200,781 B2
(45) Date of Patent: Feb. 5, 2019

(54) SOUND OUTPUT APPARATUS

(71) Applicant: LG Electronics Inc., Seoul (KR)

(72) Inventors: Hyunsun Yoo, Seoul (KR); Seungjong Park, Seoul (KR); Sangwoo Seo, Seoul (KR)

(73) Assignee: LG Electronics Inc., Seoul (KR)

( * ) Notice: Subject to any disclaimer, the term of this patent is extended or adjusted under 35 U.S.C. 154(b) by 287 days.

(21) Appl. No.: 15/236,181

(22) Filed: Aug. 12, 2016

(65) Prior Publication Data

US 2017/0055064 A1 Feb. 23, 2017

Related U.S. Application Data

(60) Provisional application No. 62/206,322, filed on Aug. 18, 2015.

(30) Foreign Application Priority Data

Sep. 3, 2015 (KR) ..... 10-2015-0125084
Jul. 26, 2016 (KR) ..... 10-2016-0094527

(51) Int. Cl.

| | |
|---|---|
| ***H04R 1/02*** | (2006.01) |
| ***H04R 1/26*** | (2006.01) |
| ***H04R 1/28*** | (2006.01) |
| ***H04R 1/32*** | (2006.01) |
| ***H04R 3/14*** | (2006.01) |

(52) U.S. Cl.

CPC ..... *H04R 1/26* (2013.01); *H04R 1/025* (2013.01); *H04R 1/026* (2013.01); *H04R 1/323* (2013.01);

(Continued)

(58) Field of Classification Search

CPC ..... H04R 1/26; H04R 1/025; H04R 1/026; H04R 1/323; H04R 3/14; H04R 1/2834;

(Continued)

(56) References Cited

U.S. PATENT DOCUMENTS 3,326,321 A 6/1967 Valuch
4,348,549 A 9/1982 Berlant (Continued)

FOREIGN PATENT DOCUMENTS

CN 102763433 A 10/2012
CN 202652498 U 1/2013

(Continued)

OTHER PUBLICATIONS

Withers, "Samsung R7 360 Wireless Speaker Review," Retrieved from URL:https://www.avforums.com/review/samsung-r7-360-wireless-speaker-review.11744, Jul. 27, 2015, 9 pages.

*Primary Examiner* — Sean H Nguyen

(74) *Attorney, Agent, or Firm* — Birch, Stewart, Kolasch & Birch, LLP

(57) ABSTRACT

A sound output apparatus is provided, which includes an outer case having an upper portion with an opening formed upward, and a lower portion with sound holes formed therethrough, a first sound output unit provided at an upper side within the outer case and capable of outputting sounds of a first frequency band, a second sound output unit provided at a lower side within the outer case and capable of outputting sounds of a second frequency band, and a conveying device provided below the first sound output unit and capable of moving the first sound output unit up and down, wherein the conveying device allows the first sound output unit to protrude upwardly such that sounds are output between the outer case and the first sound output unit.

18 Claims, 27 Drawing Sheets

(52) U.S. Cl.
CPC ..... *H04R 3/14* (2013.01); *H04R 1/2834* (2013.01); *H04R 2201/025* (2013.01); *H04R 2201/028* (2013.01); *H04R 2201/34* (2013.01)

(58) Field of Classification Search
CPC ..... H04R 2201/025; H04R 2201/028; H04R 2201/34
USPC ..... 381/387
See application file for complete search history.

(56) References Cited

U.S. PATENT DOCUMENTS

| | | | |
|---|---|---|---|
| 7,116,795 | B2 | 10/2006 | Tuason et al. |
| 2004/0156523 | A1 | 8/2004 | Tuason et al. |

FOREIGN PATENT DOCUMENTS

| | | | |
|---|---|---|---|
| CN | 203691568 | U | 7/2014 |
| EP | 2495993 | A1 | 9/2012 |
| EP | 2903298 | A1 | 8/2015 |
| GB | 245933 | A | 10/2009 |
| GB | 2459338 | A | 10/2009 |
| JP | 52-43422 | U | 10/1977 |
| JP | 2007-20893 | A | 2/2007 |
| JP | 2008-182482 | A | 8/2008 |
| JP | 3181642 | U | 2/2013 |
| JP | 2013-509801 | A | 3/2013 |
| KR | 10-2000-0044261 | A | 7/2000 |
| KR | 10-1066527 | B1 | 9/2011 |
| KR | 10-2012-0059308 | A | 6/2012 |
| TW | 201251474 | A1 | 12/2012 |
| WO | WO 98/09273 | A1 | 3/1998 |

SOUND OUTPUT APPARATUS

CROSS-REFERENCE TO RELATED APPLICATION

Pursuant to 35 U.S.C. § 119, this application claims the benefit of earlier filing dates and rights of priority to Korean Applications No. 10-2015-0125084, filed on Sep. 3, 2015, No. 10-2016-0094527, filed on Jul. 26, 2016, and U.S. Provisional Application No. 62/206,322, filed on Aug. 18, 2015, the contents of each are incorporated by reference herein in their entireties.

BACKGROUND OF THE INVENTION

1. Field of the Invention

This specification relates to a sound output apparatus capable of outputting sounds in an omnidirectional manner.

2. Background of the Invention

In general, a sound output apparatus, for example, a speaker refers to an apparatus of converting an electric signal into a sound signal (or audio signal) and outputting the sound signal. Most of sound output apparatuses output sounds in a specific direction. In this instance, a person or user can well listen to the output sounds only when the user is located in the specific direction.

In recent time, with an increasing interest in portable sound output apparatuses, sound output apparatuses which output sounds in connection with other electronic devices have various shapes, structures and sizes according to their use purposes. For example, a sound output apparatus of outputting low sound and a sound output apparatus of outputting high sound may have different shapes, structures, sizes and the like from each other.

However, most of sound output apparatuses according to the related art have designs in a rectangular shape which looks rigid. Also, those sound output apparatuses output sounds in one direction, which makes it difficult for a person located in another direction to listen to the sounds. In addition, one sound output apparatus has a single sound output port, which causes inconvenience in outputting sounds of various frequency bands.

SUMMARY OF THE INVENTION

Therefore, an aspect of the detailed description is to solve the aforementioned problems and other drawbacks of the related art. Another aspect of the detailed description is to provide a sound output apparatus, capable of outputting sounds in an omnidirectional manner.

To achieve these and other advantages and in accordance with the purpose of this specification, as embodied and broadly described herein, there is provided a sound output apparatus including an outer case having an upper portion with an opening formed upward, and a lower portion with sound holes formed therethrough, a first sound output unit provided at an upper side within the outer case and capable of outputting sounds of a first frequency band, a second sound output unit provided at a lower side within the outer case and capable of outputting sounds of a second frequency band, and a conveying device provided below the first sound output unit and capable of moving the first sound output unit up and down, wherein the conveying device allows the first sound output unit to protrude upwardly such that sounds are output between the outer case and the first sound output unit.

In one exemplary embodiment of the present invention, the first sound output unit may include a first speaker module capable of generating the sounds of the first frequency band, a first sound path generating unit provided above the first speaker module and capable of reflecting the sounds generated from the first speaker module in a lateral direction, and a first sound transfer unit provided at an outer periphery of the first sound path generating unit and capable of outputting the sounds reflected from the first sound path generating unit to outside.

In one exemplary embodiment of the present invention, the first sound output unit may further include a first upper case having a through hole formed through a central portion thereof, and a second upper case connected to a lower portion of the first upper case and defining an accommodation space for the first speaker module.

In one exemplary embodiment of the present invention, the second upper case may include a first barrier wall formed in a cylindrical shape, and a second barrier wall bent from a top of the second upper case to an outside of the first barrier wall and extending downward. The first wall and the second wall may form a guide groove.

In one exemplary embodiment of the present invention, a sliding guide formed in a cylindrical shape may be provided at a lower portion of the second upper case. The sliding guide may be provided with a wall portion protruding toward the guide groove such that the guide groove is moved up and down on the wall portion.

In one exemplary embodiment of the present invention, a protruding portion may be formed within the second upper case to be brought into contact with a lower portion of the first speaker module, and a plunger may be formed at an opposite surface to the protruding portion to downwardly extend from the second upper case.

In one exemplary embodiment of the present invention, the conveying device may be provided below the second upper case. The conveying device may include a first elastic member on which the plunger is located, a pair of damping gears provided at one side of the first elastic member, a latch plate on which a pair of rack gears upwardly protrude to be coupled to the damping gears, and a latch switch locked at a through hole formed through a central portion of the latch plate.

In one exemplary embodiment of the present invention, the damping gears may be coupled to the first barrier wall of the second upper case.

In one exemplary embodiment of the present invention, the pair of rack gears may be point-symmetric based on the center of the latch plate.

In one exemplary embodiment of the present invention, a tilt portion may be formed at a lower surface of the first sound path generating unit in a manner of being upwardly tilted from center to outside of the first sound path generating unit.

In one exemplary embodiment of the present invention, the first sound transfer unit may include a mold portion formed in a cylindrical shape and defining an outer surface thereof, and a grille portion located in the mold portion and coupled to the mold portion by hooks. A closure member which is made of jersey may be provided along an outer surface of the mold portion.

In one exemplary embodiment of the present invention, the second sound output unit may include a second speaker module capable of generating the sounds of the second frequency band in a downward direction, and a second sound path generating unit provided below the second speaker module and capable of reflecting the sounds generated from the second speaker module in a lateral direction.

In one exemplary embodiment of the present invention, the second sound path generating unit may have a convex shape toward the second speaker module, and be inclined downward from its center toward a lower portion.

In one exemplary embodiment of the present invention, a lower case formed in a cylindrical shape may be provided below the latch plate. The lower case may include a first lower case provided at an upper side, and a second lower case coupled to a lower portion of the first lower case. The second speaker module may be accommodated in a space defined by the first and second lower cases.

In one exemplary embodiment of the present invention, at least one through hole may be formed through a side surface of the first lower case. A vibration member may be provided in the through hole. Sounds of a third frequency band may be output to outside through the sound holes, in response to vibration of the vibration member caused by sounds output from a rear surface of the second speaker module.

In one exemplary embodiment of the present invention, the vibration member may include a rubber member formed convex or concave toward an outside and formed in a shape of a rectangular frame, a metal member provided in the rubber member and vibrating together with the rubber member, and a frame provided at an outer side of the rubber member and coupled to the first lower case.

In one exemplary embodiment of the present invention, a sub printed circuit board controlling the second sound output unit may be provided beneath the second sound path generating unit. A printed circuit board fixing plate for fixing the sub printed circuit board may be provided beneath the sub printed circuit board. The printed circuit board fixing plate may be accommodated in a lower cap sealing a lower end portion of the sound output apparatus.

In one exemplary embodiment of the present invention, ribs may protrude from the lower cap with a predetermined interval, so as to obscure some of the sound holes.

In one exemplary embodiment of the present invention, the lower cap may be rotatable in a manner that a central portion of the lower cap is coupled to the printed circuit board fixing plate.

In one exemplary embodiment of the present invention, the ribs may be formed with an interval of 120° based on the center of the lower cap.

The sound output apparatus according to the present invention may provide the following effects.

In accordance with at least one of embodiments of the present invention, sounds generated from a speaker module can be reflected so as to be radiated in an omnidirectional manner.

In accordance with at least one of embodiments of the present invention, the sound output apparatus can be turned on/off and simultaneously paired with another electronic device, in response to a single push input.

In accordance with at least one of embodiments of the present invention, sounds of various frequency bands can be output at the same time.

In accordance with at least one of embodiments of the present invention, the sound output apparatus can be fabricated in a shape of a cylinder or tumbler with smooth appearance, thereby providing attractive design and high portability.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail according to exemplary embodiments disclosed herein, with reference to the accompanying drawings. For the sake of brief description with reference to the drawings, the same or equivalent components may be provided with the same or similar reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In the present invention, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present invention should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are generally only used to distinguish one element from another.

It will be understood that when an element is referred to as being "connected with" another element, the element can be connected with the other element or intervening elements may also be present. In contrast, when an element is referred to as being "directly connected with" another element, there are no intervening elements present.

A singular representation may include a plural representation unless it represents a definitely different meaning from the context.

Terms such as "include" or "has" are used herein and should be understood that they are intended to indicate an existence of several components, functions or steps, disclosed in the specification, and it is also understood that greater or fewer components, functions, or steps may likewise be utilized.

Hereinafter, description will be given of embodiments related to a sound output apparatus according to the present invention with reference to the accompanying drawings. It is obvious to those skilled in the art that the present invention can be specified into other particular forms without departing from the spirit and essential features of the present invention.

Figure 1A:
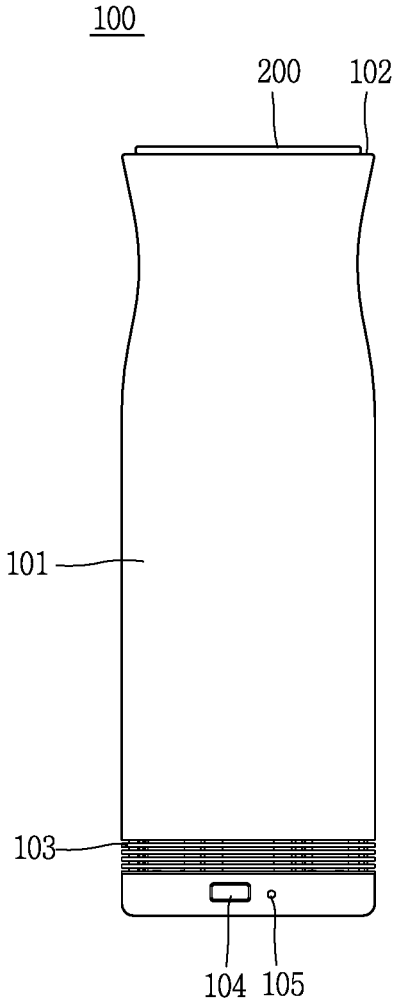
FIG. 1A is a front view of a sound output apparatus in a first state in accordance with one embodiment of the present invention.
Figure 1B:
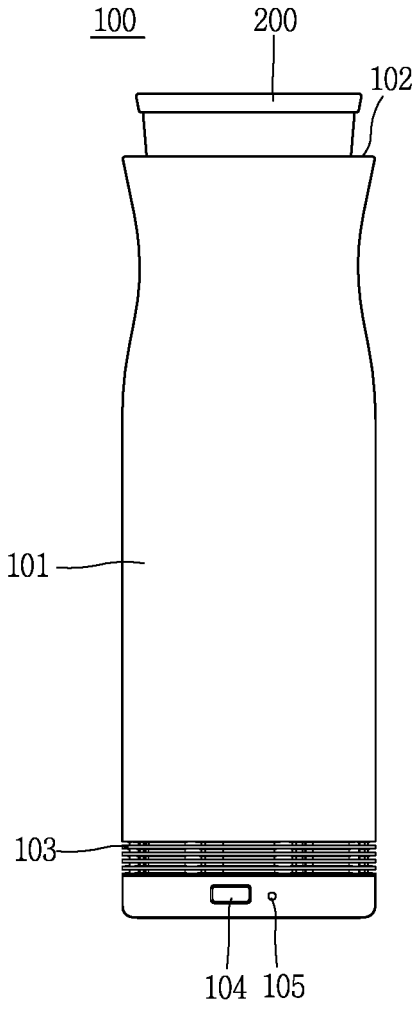
FIG. 1B is a front view of the sound output apparatus in a second state in accordance with the one embodiment of the present invention.
Figure 2A:
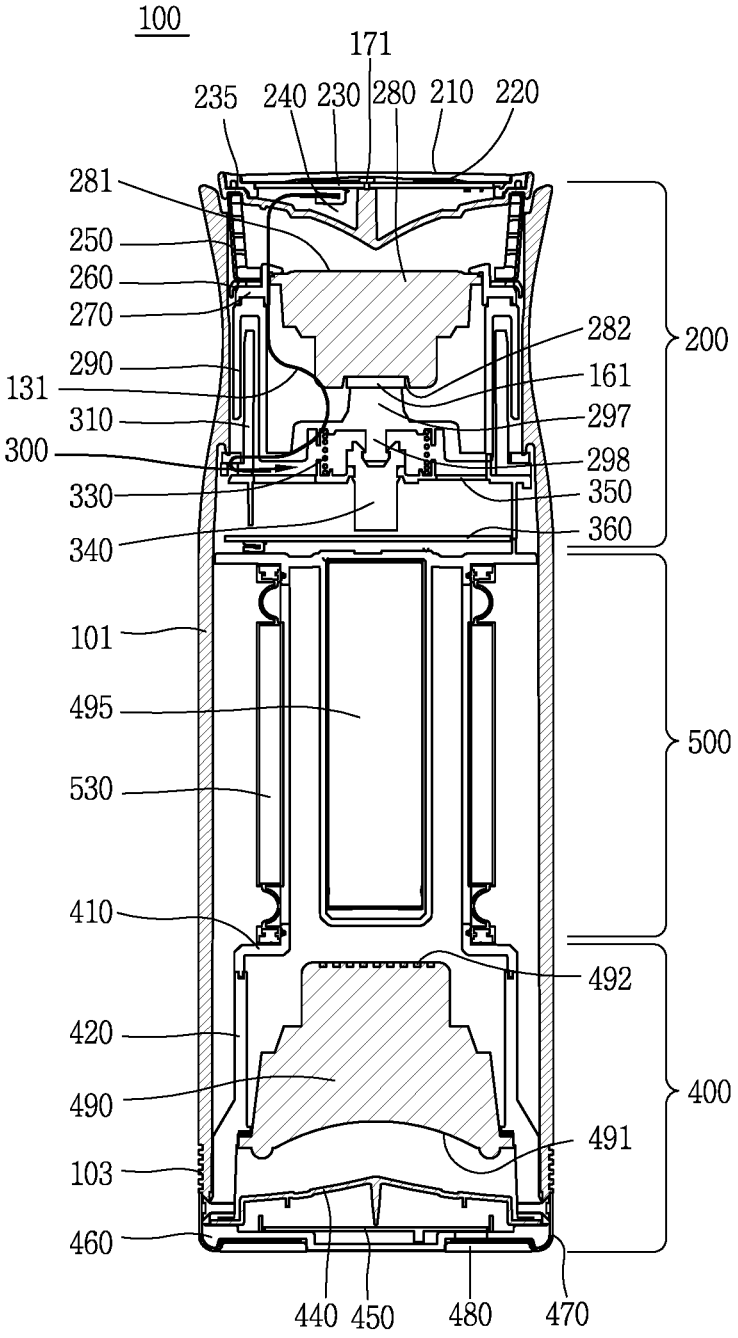
FIG. 2A is a sectional view of the sound output apparatus in the first state in accordance with the one embodiment of the present invention.
Figure 2B:
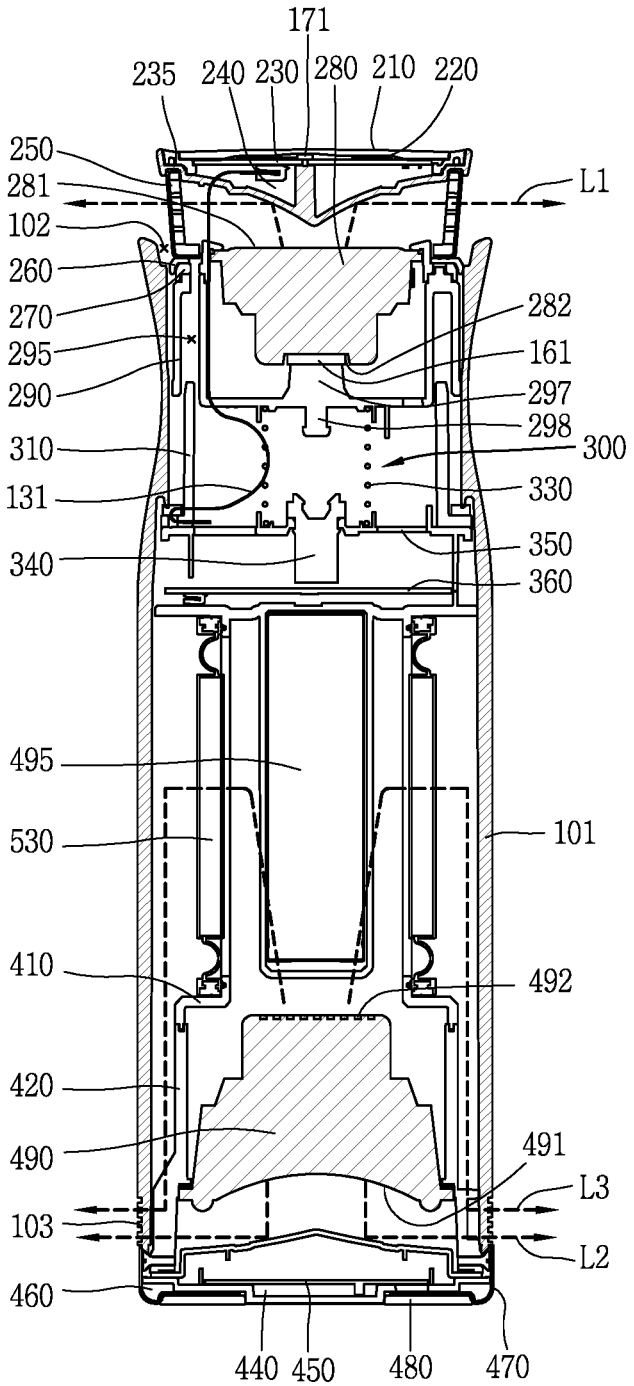
FIG. 2B is a sectional view of the sound output apparatus in the second state in accordance with the one embodiment of the present invention.
Figure 3:
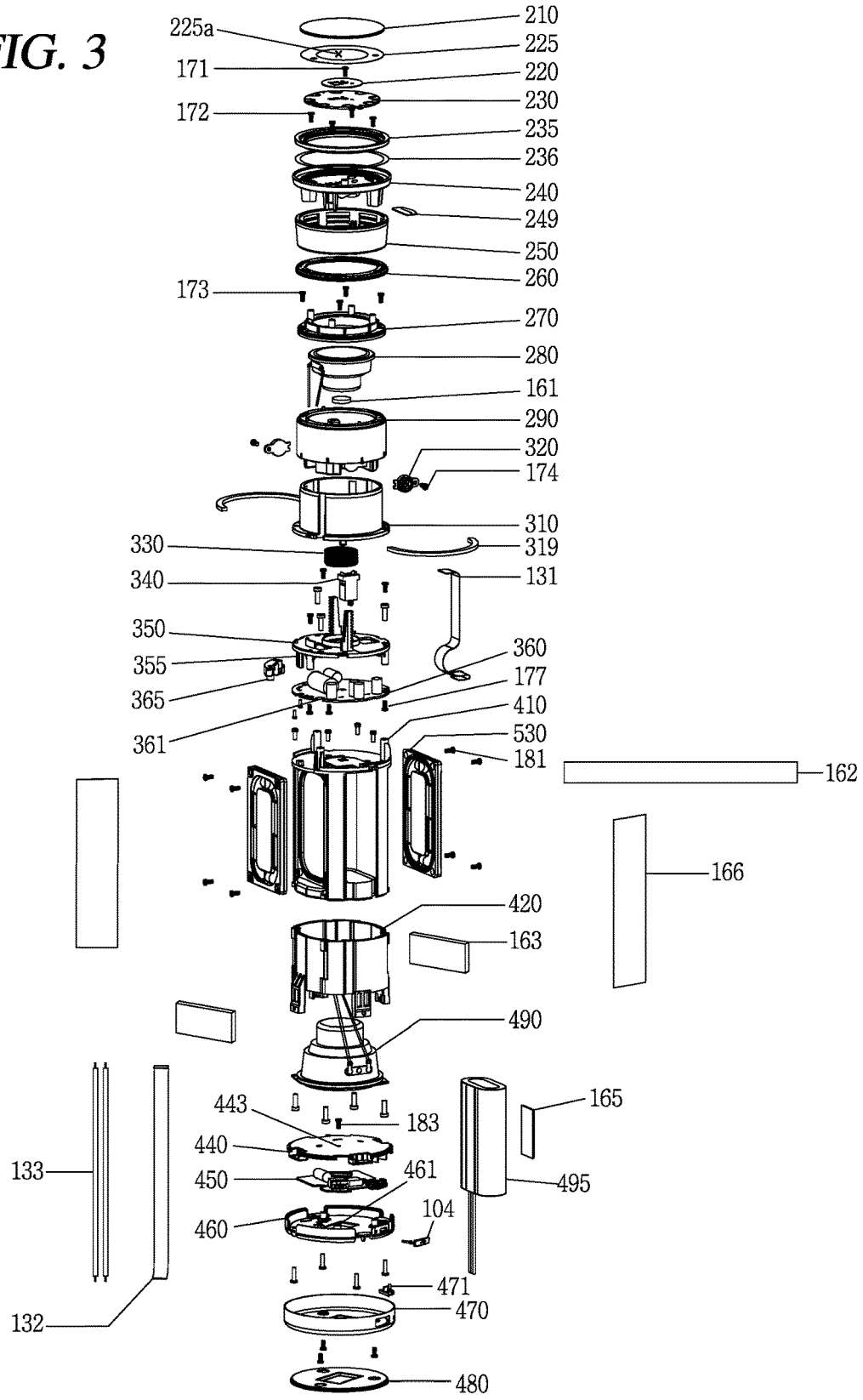
FIG. 3 is an exploded perspective view of the sound output apparatus in accordance with the one embodiment of the present invention.

FIG. 1A is a front view of a sound output apparatus 100 in a first state in accordance with one embodiment of the present invention, FIG. 1B is a front view of the sound output apparatus 100 in a second state in accordance with the one embodiment of the present invention, FIG. 2A is a sectional view of the sound output apparatus 100 in the first state in accordance with the one embodiment of the present invention, FIG. 2B is a sectional view of the sound output apparatus 100 in the second state in accordance with the one embodiment of the present invention, FIG. 3 is an exploded perspective view of the sound output apparatus 100 in accordance with the one embodiment of the present invention. That is, FIGS. 2A and 2B may be understood as sectional views of FIGS. 1A and 1B, respectively.

One embodiment of the present invention illustrates a sound output apparatus 100 in a shape of a cylinder or tumbler. Hereinafter, a structure of the sound output apparatus 100 according to the one embodiment of the present invention will be described with reference to FIGS. 1 to 3.

The sound output apparatus 100 according to the one embodiment of the present invention may include a plurality of sound output units provided within an outer case 101, which is externally exposed and has a shape of a cylinder or tumbler. The outer case 101 may be formed such that a lower surface thereof is closed and an upper surface is open to form an opening 102. Sound holes may be formed through a lower portion of the outer case 101 along an outer circumference of the outer case 101. The sound output apparatus 100 according to the one embodiment may include a first sound output unit 200 outputting sounds through an upper portion of the outer case 101, and a second sound output unit 400 externally outputting sounds through the sound holes 103 formed at the lower portion of the outer case 101. In this instance, the second sound output unit 400 may omnidirectionally (360°) output sounds to surroundings of the outer case 101.

The opening 102 illustrated in FIGS. 1A and 1B is formed in a circular shape with being closed by the first sound output unit 200, but the opening 102 in the one embodiment may not be necessarily limited to such region. The opening may also be formed at an entire upper surface of the external case 101 in a removed state of the first sound output unit 200. The first sound output unit 200 may be configured in a manner that sounds generated by a first speaker module 280 to be explained later are blocked by a first sound path generating unit 240, which is formed in the opening 102 of the external case 101 and thus leaked through the opening 102 between the first sound path generating unit 240 and the external case 101. In this instance, the first sound path generating unit 240 may be in a shape of a disk smaller than the opening 102. The opening 102 which is formed in a shape of a circular ring may allow a user to listen to sounds with the same sound quality in any direction of the sound output apparatus 100 according to the one embodiment disclosed herein. Also, the sound holes 103 which are formed in all directions (omnidirectionally) may allow the user to listen to sounds with the same quality in any direction of the sound output apparatus 100.

Hereinafter, the sound output units according to the one embodiment of the present invention will be described in more detail. The sound output apparatus 100 according to the one embodiment disclosed herein may include a first sound output unit 200 that is disposed at an upper portion within the external case 101, is movable up and down, and is capable of outputting sounds of a first frequency band, a second sound output unit 400 that is disposed at a lower portion within the outer case 101 and is capable of outputting sounds of a second frequency band, which is the same as or different from the first frequency band, and a third sound output unit 500 that is disposed between the first sound output unit 200 and the second sound output unit 400 and is capable of outputting sounds of a third frequency band, which is the same as or different from the frequency bands of the sounds output from the first sound output unit 200 and the second sound output unit 400.

For example, the first frequency band may be a full-range frequency band. The second frequency band may be a low frequency band and the second sound output unit 400 may include a woofer speaker module. The third frequency band may be a super-low frequency band which is lower than the second frequency band. For example, the first frequency band may be 20 Hz to 20 kHz, the second frequency band may be 2 to 3 kHz, and the third frequency band may be 50 to 100 Hz. However, the present invention may not be necessarily limited to this, and the first to third frequency bands may partially overlap one another.

Hereinafter, the first sound output unit 200 will be described.

The first sound output unit 200 may be moved up and down. Namely, the first sound output unit 20 may be implemented in a first state in which it is moved down to be located at a lower position, and in a second state in which it is popped up from the first state to be located at an upper position. The operation of the first sound output unit 200 may be stopped in the first state, and started in the second state. That is, the first sound output unit 200 may be movable up and down and automatically operate in response to power supplied thereto at the moment when the first state is converted into the second state. Therefore, the second and third sound output units 400 and 500 as well as the first sound output unit 200 may not operate in the first state. In this manner, in the one embodiment of the present invention, the power supply with respect to the entire sound output apparatus 100 may be allowed or restricted by virtue of the first sound output unit 200.

The first sound output unit 200 refers to not only a portion of directly generating (or outputting) sounds (e.g., a first speaker module 280) but also a ascended or descended portion in response to the change of the first and second states. That is, a position-changed portion in FIGS. 2A and 2B is also referred to as the first sound output unit 200.

Figure 4A:
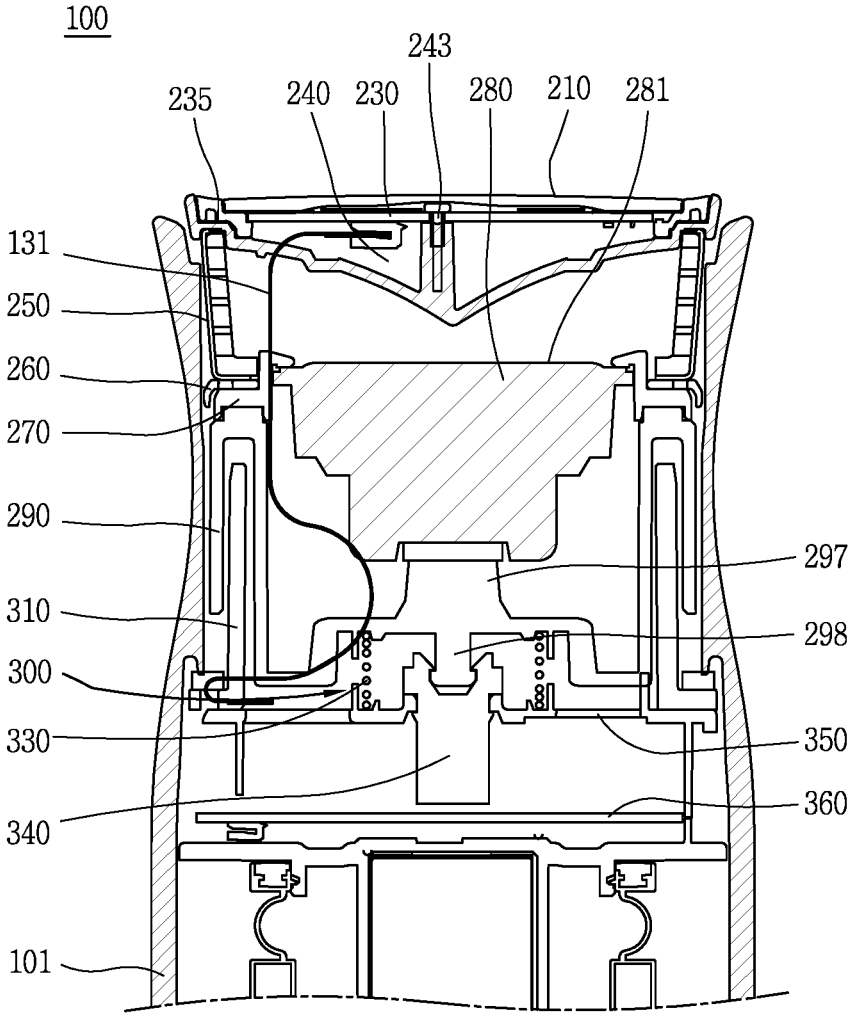
FIG. 4A is a partial enlarged view of a FIG. 2A.
Figure 4B:
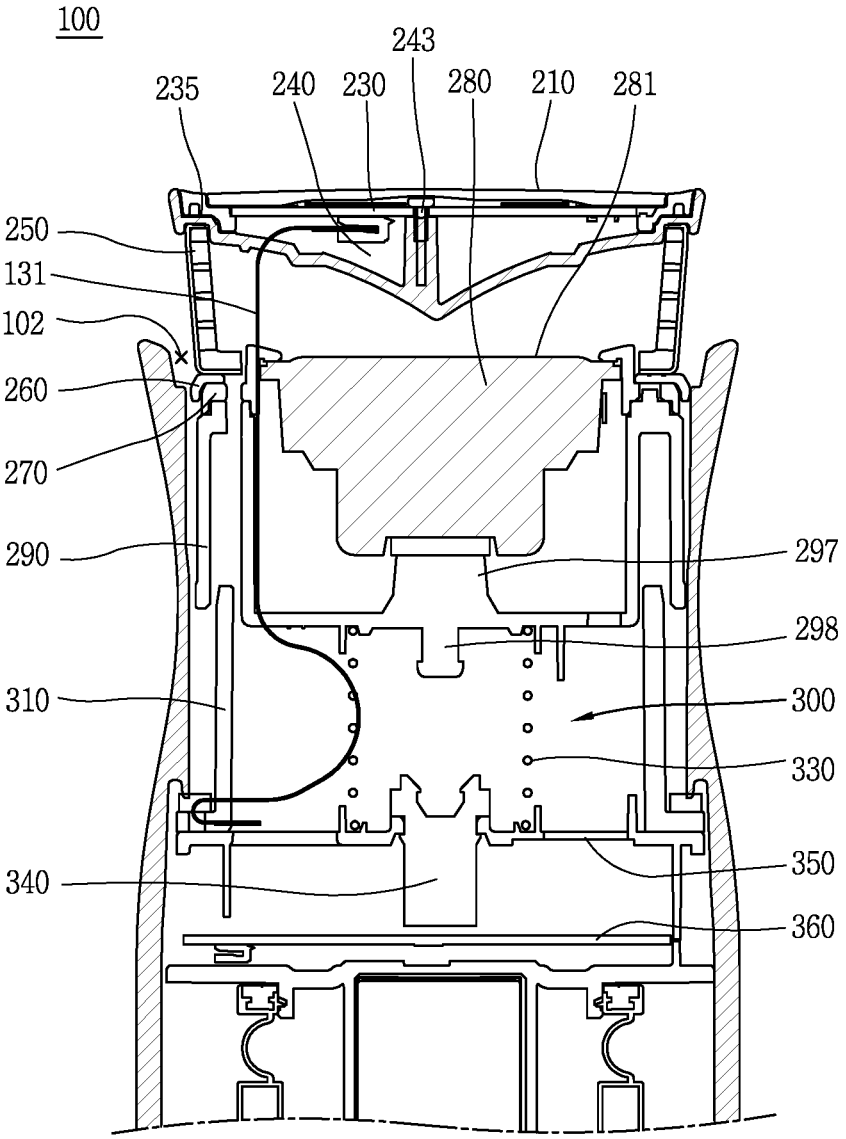
FIG. 4B is a partial enlarged view of FIG. 2B.

Also, FIG. 4A is an enlarged view of a part of FIG. 2A, which is a sectional view illustrating the first sound output unit 200 and its surroundings in the first state, and FIG. 4B is an enlarged view of a part of FIG. 2B, which is a sectional view illustrating the first sound output unit 200 and its surroundings in the second state. Referring to FIGS. 4A and 4B, the first sound output unit 200 may include a first speaker module 280 disposed in the outer case 101 and generating sounds of a first frequency band, a conveying device 300 disposed below the first speaker module 280 and allowing the first sound output unit 200 to be moved up and down (ascended or descended), a first sound transfer unit 250 disposed at an upper portion of the first speaker module 280 and transferring the sounds generated from the first speaker module 280 to outside, and a first sound path generating unit 240 disposed above the first sound transfer unit 250 to guide the sounds generated from the first speaker module 280 to be radiated to outside. That is, the first speaker module 280 may include a vibration plate 281 that is disposed at a top thereof and vibrates up and down to generate a sound pressure difference such that sounds can be upwardly output, and other components, such as a magnet (not illustrated), a voice coil (not illustrated) and the like, disposed in a lower portion thereof.

The first speaker module 280 may be accommodated in a first upper case 270 having a through hole 272 (see FIG. 10A) formed through a central portion thereof, and a second upper case 290 connected to a lower portion of the first upper case 270 and forming an accommodation space of the first speaker module 280 along with the first upper case 270. In this instance, sounds output from the first speaker module 280 may move to the first sound transfer unit 250 through the through hole 272.

An edge of the first upper case 270 may be coupled to a moving guide cover 260. The second upper case 290 may be coupled to a lower portion of the first upper case 270, and accordingly the first speaker module 280 may be accommodated between the first upper case 270 and the second upper case 290. The second upper case 290 may be provided with a guide groove 295 (see FIG. 11C) which is formed by a barrier wall structure in a conveying (moving) direction.

Figure 11A:
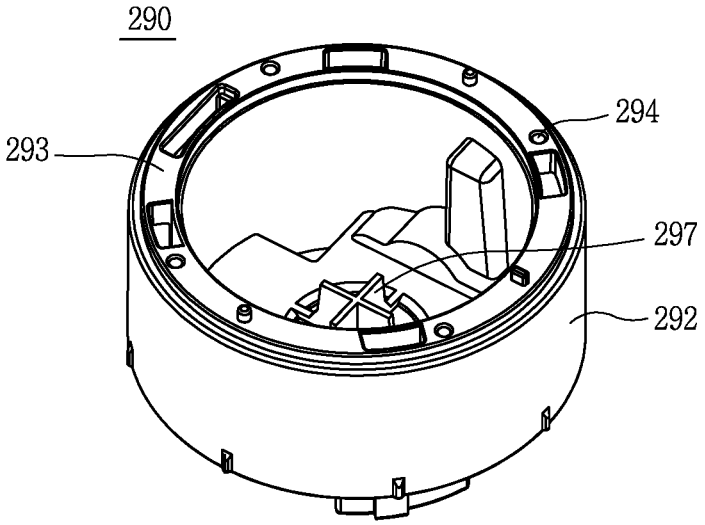
FIG. 11A is a perspective view of a second upper case in accordance with the one embodiment of the present invention.
Figure 11B:
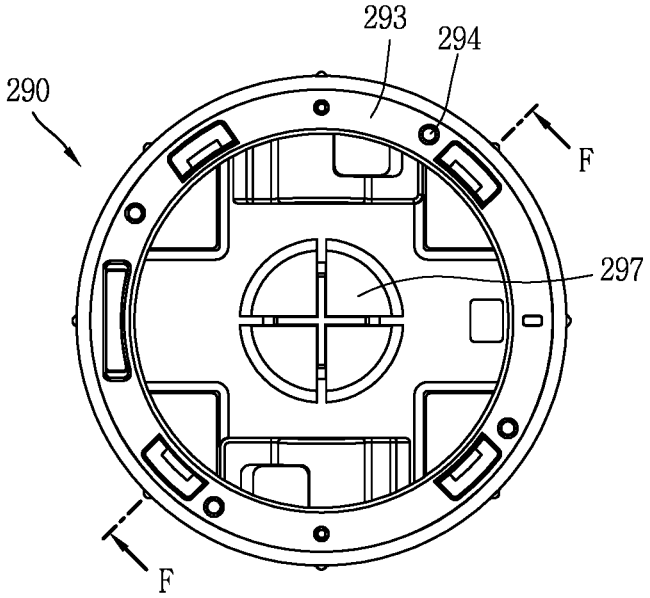
FIG. 11B is a planar view of FIG. 11A.
Figure 11C:
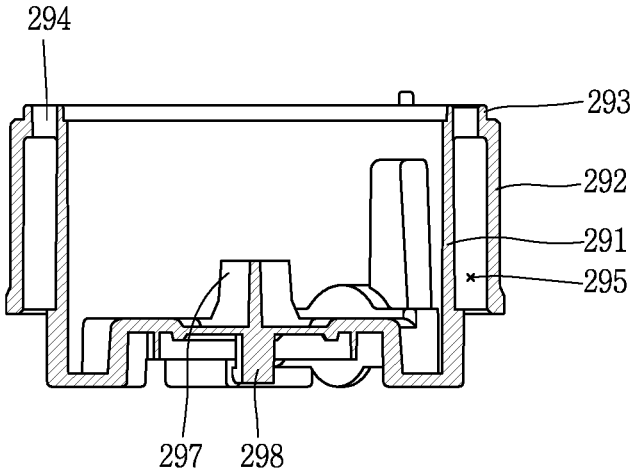
FIG. 11C is a sectional view taken along the line F-F of FIG. 11B.

FIG. 11A is a perspective view of the second upper case in accordance with the one embodiment of the present invention, FIG. 11B is a planar view of FIG. 11A, and FIG. 11C is a sectional view taken along the line F-F of FIG. 11B. As illustrated in FIGS. 11A to 11C, the second upper case 290 may include a first barrier wall 291 formed inside thereof and having a cylindrical shape, and a second barrier wall 292 bent from a top of the second upper case 290 to an outside of the first barrier wall 291 and extending downward. The first barrier wall 291 and the second barrier wall 292 may be in parallel to each other and thus the guide groove 295 may be formed between the first barrier wall 291 and the second barrier wall 292. In this instance, the first upper case 270 and the second upper case 290 may be coupled to each other along their edges so as to be integrally moved up and down.

Figure 8A:
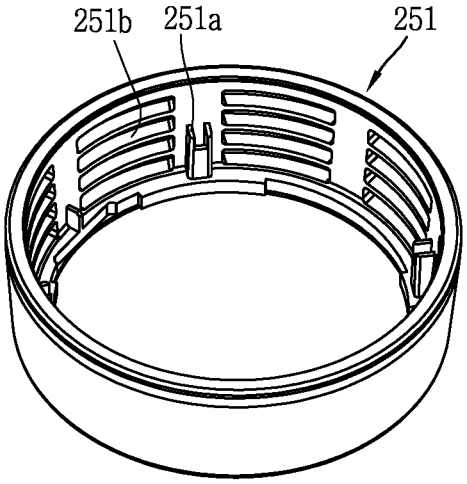
FIG. 8A is a perspective view of a mold portion of a first sound transfer unit in accordance with the one embodiment of the present invention.
Figure 8B:
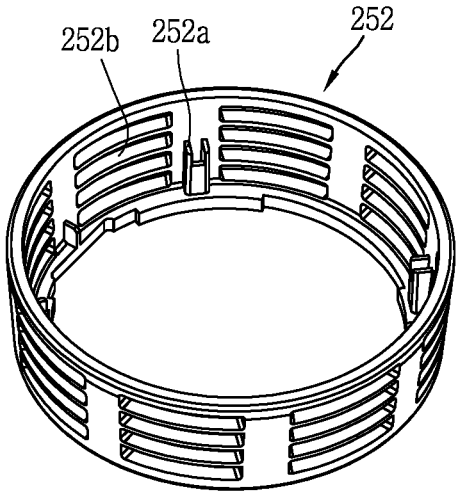
FIG. 8B is a perspective view of a grille portion of the first sound transfer unit in accordance with the one embodiment of the present invention.
Figure 8C:
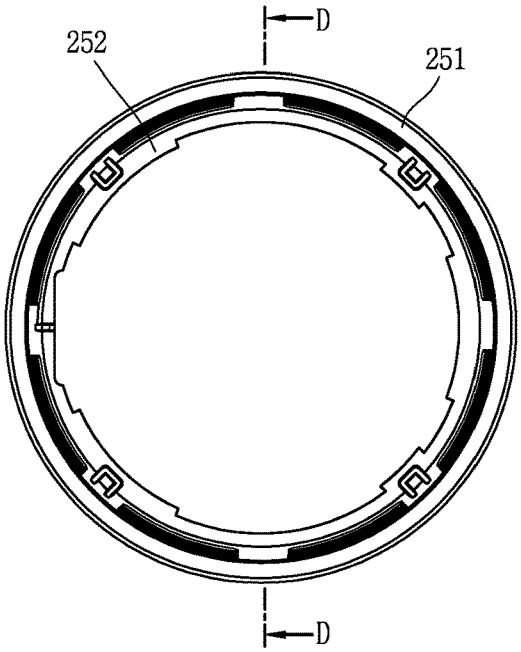
FIG. 8C is a planar view of the first sound transfer unit in accordance with the one embodiment of the present invention.
Figure 8D:
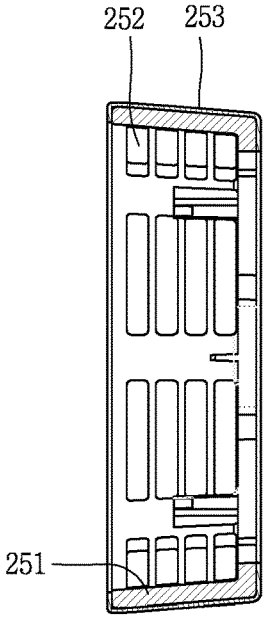
FIG. 8D is a sectional view taken along the line D-D of FIG. 8C.

The first sound transfer unit 250 may be coupled to an upper portion of the first upper case 270. The first sound transfer unit 250 may have a hollow cylindrical shape, and a first sound path generating unit 240 may be disposed in the first sound transfer unit 250. FIG. 8A is a perspective view of a mold portion 251 of the first sound transfer unit 250 in accordance with the one embodiment of the present invention, FIG. 8B is a perspective view of a grille portion of the first sound transfer unit 250 in accordance with the one embodiment of the present invention, FIG. 8C is a planar view of the first sound transfer unit 250 in accordance with the one embodiment of the present invention, and FIG. 8D is a sectional view taken along the line D-D of FIG. 8C. As illustrated in FIGS. 8A to 8D, the first sound transfer unit 250 may be configured by coupling a mold portion 251 formed in a cylindrical shape and defining an outer surface thereof to a grille portion 252 located in the mold portion 251. In this instance, the coupling between the mold portion 251 and the grille portion 252 may be implemented in a manner of coupling hooks 251*a* and 252*a* provided in the mold portion 251 and the grille portion 252, respectively. That is, the hooks 251*a* and 252*a* may be provided at the mold portion 251 and the grille portion 252, respectively, at positions facing each other, and arranged on inner surfaces of the mold portion 251 and the grille portion 252 with predetermined spaced distances. The sounds output from the first speaker module 280 may be radiated outward through the grille portion 252. That is, the first sound transfer unit 250 may serve as a path for transferring the sounds of the first sound output unit 200. In this instance, a closure member 253 which is made of jersey may be provided along an outer surface of the mold portion 251 to prevent an introduction of dust and the like from outside.

The mold portion 251 may serve to protect the grille portion 252 at the outside of the grille portion 252. In this instance, the mold portion 251 may be molded (formed) on only a region large enough that sounds can be output to outside in the second state.

In this instance, a plurality of grooves 251*b* may be formed at an inner side of the mold portion 251. The grooves 251*b* may be located at positions corresponding to a plurality of grooves 252*b* which protrude into an inner side surface of the grille portion 252. The grooves 251*b* and 252*b* may be formed at the positions corresponding to each other, which may allow sounds to be externally radiated by minimizing a reflection of the sounds.

Figure 7A:
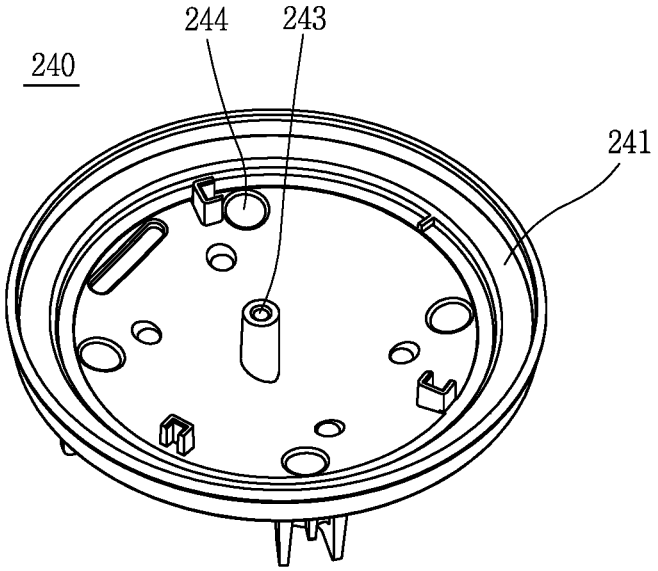
FIG. 7A is a perspective view of a first sound path generating unit in accordance with the one embodiment of the present invention.
Figure 7B:
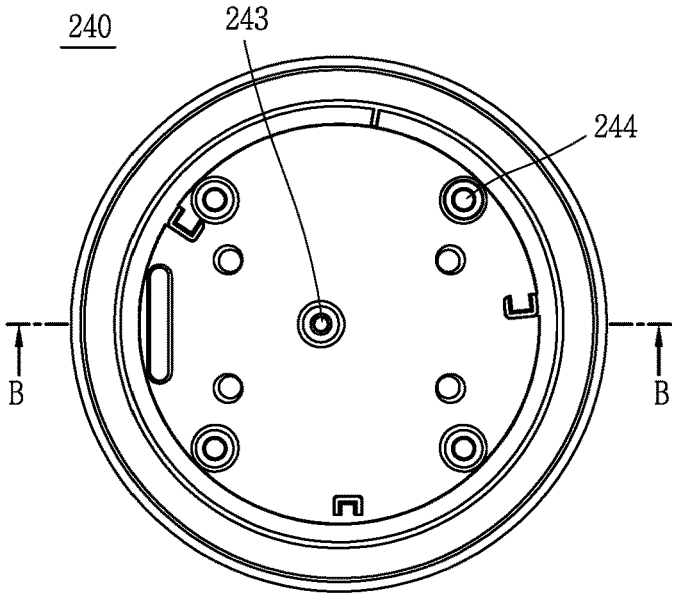
FIG. 7B is a plan view of FIG. 7A.
Figure 7C:
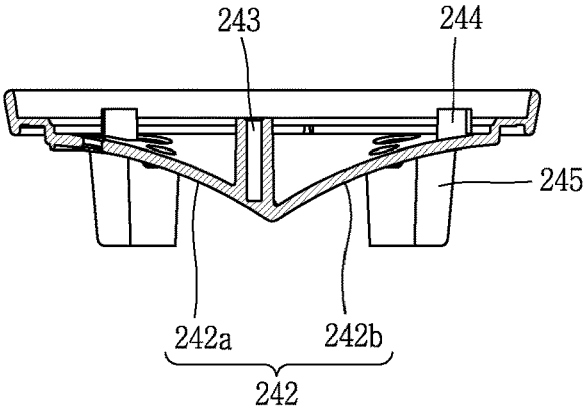
FIG. 7C is a sectional view taken along the line B-B of FIG. 7B.

FIG. 7A is a perspective view of the first sound path generating unit 240 in accordance with the one embodiment of the present invention, FIG. 7B is a plan view of FIG. 7A, and FIG. 7C is a sectional view taken along the line B-B of FIG. 7B. As illustrated in FIGS. 7A to 7C, the first sound path generating unit 240 may have an approximately hemispherical shape. The first sound path generating unit 240 may have an upper surface recessed toward a lower portion thereof, and be provided with a plurality of bosses 245 downwardly protruding from a lower surface thereof. The bosses 245 may be coupled to the first upper case 270 by coupling members 172 (see FIG. 3). A tilt portion 242 (242*a*, 242*b*) may be formed at the lower surface of the first sound path generating unit 240 in a manner of being upwardly tilted from center to outside of the first sound path generating unit 240, such that sounds generated from the first speaker module 280 can go toward a side surface, other than an upper portion. This may allow the sounds output from the first speaker module 280 to be radiated in a lateral direction, other than an upward direction, because the upper portion of the first sound path generating unit 240 is blocked by a decoration plate 210. For example, as illustrated in FIG. 2B, a moving path L1 of the sounds from the first sound output unit 200 is made in a manner that the sounds output from the first speaker module 280 is reflected by the tilt portion 242 of the first sound path generating unit 240 and output to outside through the first sound transfer unit 250.

The first sound path generating unit 240 may be provided with a boss 243 protruding from center to top thereof, and an upper surface of the first sound path generating unit 240 may have a symmetrical shape based on the boss 243. A near field communication (NFC) 200 and a touch printed circuit board 230 may be coupled to the first sound path generating unit 240 by inserting a coupling member 171 through the boss 243 (See FIGS. 2A and 3).

Figure 21:
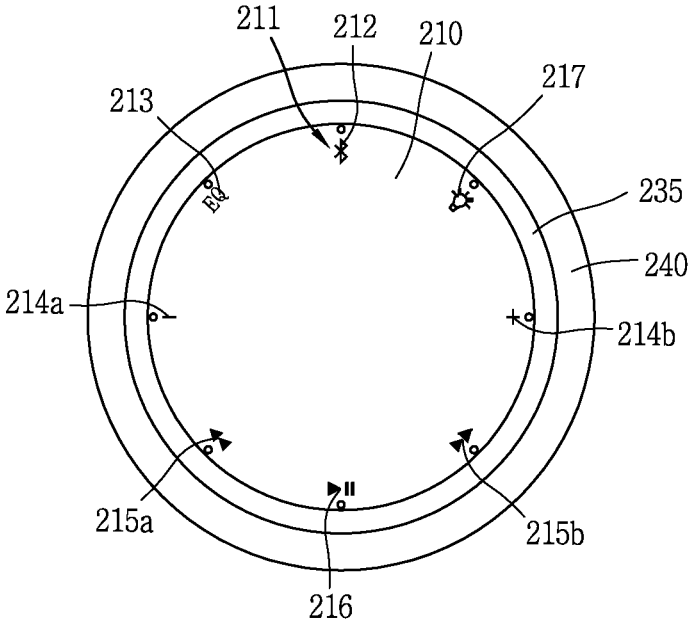
FIG. 21 is a view of a sound control display unit in accordance with the one embodiment of the present invention.

Referring back to FIG. 2B, the first sound path generating unit 240 serves to change the path of sounds from top to side, namely, it functions similar to a lens of a camera which changes a refracting direction of light. Therefore, the first sound path generating unit 240 may be referred to as an acoustic lens. A decoration plate 210 may be disposed at an upper side of the first sound path generating unit 240 to be externally exposed. The decoration plate 210 may have a shape of a circular plate. A touch printed circuit board 230 which recognizes a touch input when the touch input is applied to the decoration plate 210 may be provided at a lower portion of the decoration plate 210. A volume level (volume-up/down; 214*a*, 214*b*) of output sounds, a reproduction sequence (previous/next/pause; 215*a*, 215*b*, 216) of sounds, and a type of output sounds (equalizer (EQ); 213) may be selectable by touching the decoration plate 210 (see FIG. 21). Also, a short-range wireless communication mode 212 with another electronic device, for example, a BLUETOOTH™ mode or a WiFi mode may be indicated on the decoration plate 210. In addition, a lamp (LED) 217 may be disposed at the decoration plate 210 so as for a user to set a desired mood.

Referring to FIG. 3, an adhesive member 225 may be provided between the touch printed circuit board 230 and the decoration plate 210, such that the decoration plate 210 can be attached onto the touch printed circuit board 230. The adhesive member 225 may be a both-sided tape. The adhesive member 225 may be provided with a through hole 225*a* formed through a center thereof. The NFC 220 may be provided through the through hole 225*a*. At least part of an upper surface of the NFC 220 may penetrate through the through hole 225*a* so as to be brought into contact directly with the decoration plate 210, and a lower surface thereof may be attached on the touch printed circuit board 230.

That is, the touch printed circuit board 230 in a circular shape (or a disk-like shape) may be disposed at the rear surface of the decoration plate 210 and the circular NFC 220 which is smaller than the touch printed circuit board 230 may be disposed between the decoration plate 210 and the touch printed circuit board 230. The NFC 220 may enable a wireless communication in a state that another electronic device is brought into contact with or almost brought into contact with the NFC 220. Thus, the NFC 220 is a component which is different from a BLUETOOTH™ or WiFi module which enables wireless communication at a short distance in a spaced state from another electronic device. A lighting member 235 in a ring shape may be provided on an edge of the decoration plate 210. The lighting member 235 may serve as a light guide for allowing light of an LED to be emitted to outside.

That is, the short-range wireless communication is configured to facilitate short-range communications. Suitable technologies for implementing such short-range communications include at least one of BLUETOOTH™, Radio Frequency IDentification (RFID), Infrared Data Association (IrDA), Ultra-WideBand (UWB), ZigBee, Near Field Communication (NFC), Wireless-Fidelity (Wi-Fi), Wi-Fi Direct, Wireless USB (Wireless Universal Serial Bus), and the like. The short-range communication supports wireless communications between the sound output apparatus 100 and a wireless communication system, communications between the sound output apparatus 100 and another sound output apparatus 100, or communications between the sound output apparatus 100 and a network where another sound output apparatus (or an external server) is located, via wireless area networks. The short-range communication network may be a wireless personal area network.

In this manner, such short-range communication technologies such as BLUETOOTH™, Radio Frequency IDentification (RFID), Infrared Data Association (IrDA), Ultra-WideBand (UWB), ZigBee, Near Field Communication (NFC), Wireless USB (Wireless Universal Serial Bus).

Among others, the NFC module provided in the sound output apparatus may support non-contact (or contactless) short-range wireless communications between terminals at a distance of about 10 cm. The NFC module may operate in one of a card mode, a reader mode and a peer-2-peer (P2P) mode. For operating the NFC module in the card mode, the sound output apparatus 100 may further include a security module storing card information. Here, the security module may be a physical medium, such as a universal integrated circuit card (UICC) (e.g., subscriber identification module (SIM) or a universal SIM (USIM)), a secure micro SD, a speaker and the like, or a logical medium embedded in the sound output apparatus (e.g., embedded secure element (SE)). Single wire protorocl (SWP) based data exchange can be carried out between the NFC module and the security module.

When the NFC module operates in the card mode, the sound output apparatus may transfer card information to outside, like a typical IC card. However, in the one embodiment of the present invention, there may be many cases where the NFC module receives information from an electronic device located nearby. That is, in most cases, the NFC module may operate in the reader mode.

Also, when the NFC module operates in the reader mode, the sound output apparatus may read data out of an external tag. In this instance, data that the sound output apparatus receives from the tag may be coded into an NFC data exchange format set in the NFC Forum. When the NFC module operates in the P2P mode, the sound output apparatus may perform P2P communication with another sound output apparatus. In this instance, a logical link control protocol (LLCP) may be applied to the P2P communication. For the P2P communication, a connection may be established between the sound output apparatus and another sound output apparatus or another electronic device. Here, the generated connection may be divided into a connectionless mode which is terminated after exchanging one packet and a connection-oriented mode for exchanging packets in a consecutive manner. Data such as electronic business card, contact information, digital photo, URL and the like, setup parameters for connection of BLUETOOTH™ or Wi-Fi, and the like may be exchanged through the P2P communication. However, since an available distance for the NFC communication is short, the P2P mode may effectively be used for exchanging small-scaled data.

Figure 6A:
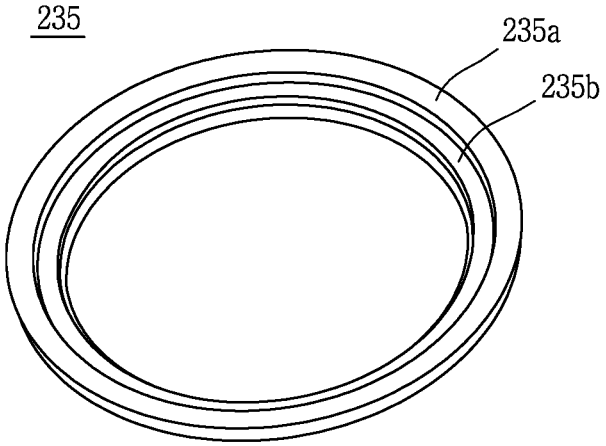
FIG. 6A is a perspective view of a lighting member in accordance with the one embodiment of the present invention.
Figure 6B:
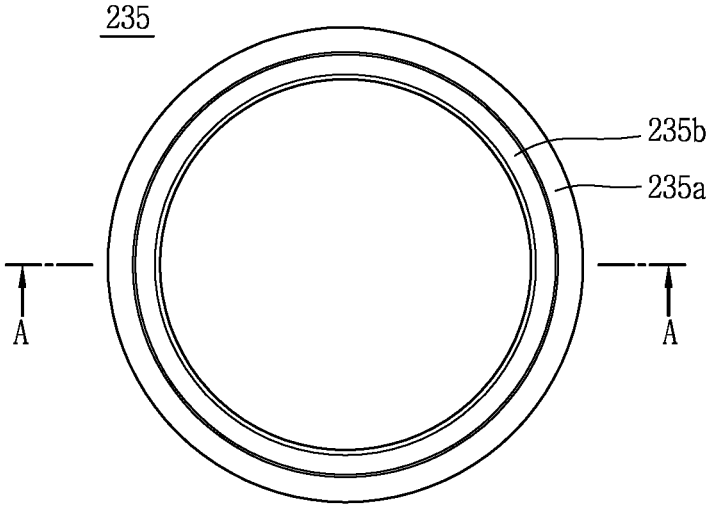
FIG. 6B is a planar view of FIG. 6A.
Figure 6C:
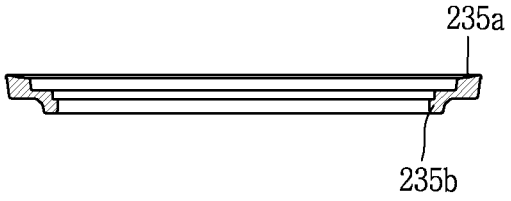
FIG. 6C is a sectional view taken along the line A-A of 6B.

FIG. 6A is a perspective view of the lighting member 235 in accordance with the one embodiment of the present invention, FIG. 6B is a planar view of FIG. 6A, and FIG. 6C is a sectional view taken along the line A-A of 6B. As illustrated in FIGS. 6A to 6C, the lighting member 235 may be stepped with forming a concentric circuit from a center thereof when viewed from a top. That is, the lighting member 235 may have an annular shape with a small thickness. The lighting member 235 may be stepped downward from the outermost edge 235*a* to the center. The decoration plate 210 may be mounted on a stepped portion 235*b* of the lighting member 235, such that the decoration plate 210 and the lighting member 235 can be flush with each other. Also, the lighting member 235 may be attached to an upper side of the first sound path generating unit 240 by an adhesive member 236 (see FIG. 3).

The first sound path generating unit 240 may also have such stepped structure of being lowered toward its inside to correspond to the stepped structure of the lighting member 235. The stepped structure of the first sound path generating unit 240 may implement a mounting structure of the lighting member 235. A part of the first sound path generating unit 240 may be accommodated in the first sound transfer unit 250. The first sound path generating unit 240, as aforementioned, may have an upwardly convex shape from center to outside, and may be symmetric based on its center. The first sound path generating unit 240 may have a through hole 244 and the moving guide cover 260 may have a through hole 261. Accordingly, the first sound path generating unit 240 and the moving guide cover 260 may be coupled to each other by inserting the coupling members 172 through the through holes 244 and 261.

Figure 9:
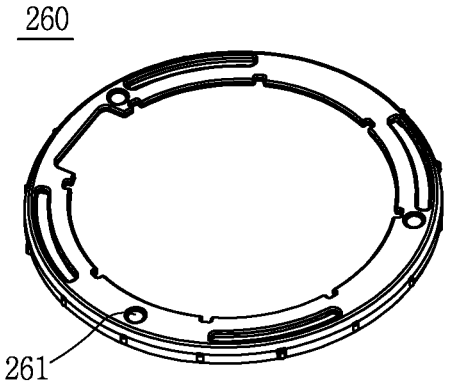
FIG. 9 is a perspective view of a moving guide cover in accordance with the one embodiment of the present invention.
Figure 10A:
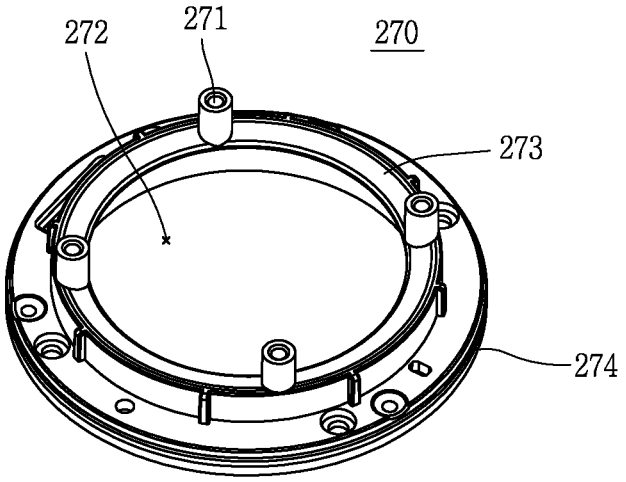
FIG. 10A is a perspective view of a first upper case in accordance with the one embodiment of the present invention.
Figure 10B:
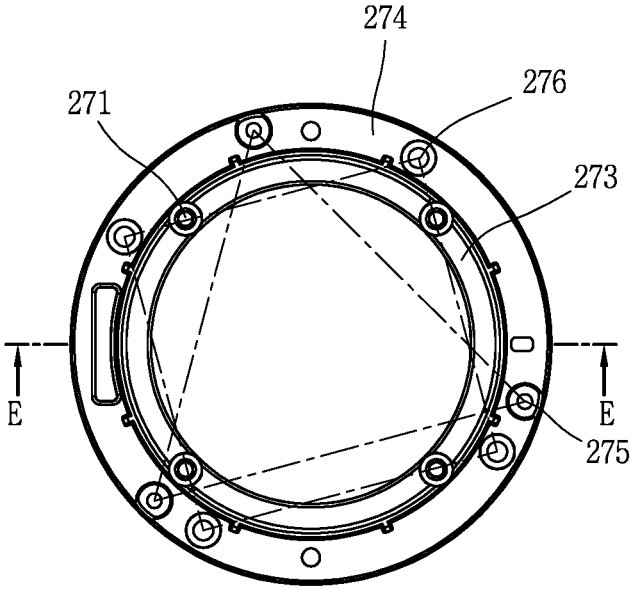
FIG. 10B is a planar view of FIG. 10A.
Figure 10C:
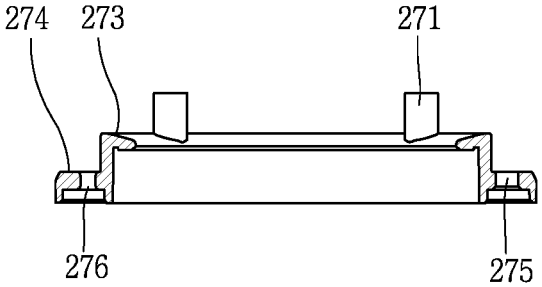
FIG. 10C is a sectional view taken along the line E-E of FIG. 10B.

FIG. 9 is a perspective view of the moving guide cover 260 in accordance with the one embodiment of the present invention, FIG. 10A is a perspective view of a first upper case in accordance with the one embodiment of the present invention, FIG. 10B is a planar view of FIG. 10A, FIG. 10C is a sectional view taken along the line E-E of FIG. 10B, FIG. 11A is a perspective view of a second upper case in accordance with the one embodiment of the present invention, FIG. 11B is a planar view of FIG. 11A, and FIG. 11C is a sectional view taken along the line F-F of FIG. 11B.

The first sound transfer unit 250 may be coupled to the first upper case 270, and the first upper case 270 may be coupled to the second upper case 290. The first upper case 270 may have an annular shape with a through hole 272 formed through a center thereof, and its inner side 273 may more protrude upwardly than its outer side 274. A plurality of bosses 271 which are coupled to the first sound path generating unit 240 may be formed at the inner side 273, and through holes 275 and 276 through which the first upper case 270 is coupled to the annular moving guide cover 260 may be formed through the outer side 274. That is, the coupling members 173 (see FIG. 3) may be inserted through the moving guide cover 260 and the first upper case 270, so as to couple the moving guide cover 260 to the first upper cover 270.

The coupling members 173 for coupling the moving guide cover 260 to the first upper cover 270 may also couple the moving guide cover 260 and the first upper case 270 to the second upper case 290. The coupling members 173 may couple the moving guide cover 260, the first upper case 270 and the second upper case 290 into an integral form. In this instance, as illustrated in FIG. 10B, through holes 275 and 276 which form a triangular shape and a rectangular shape, respectively, may be formed through the outer side 274 of the first upper case 270. The through holes 275 forming the triangular shape of the through holes 275 and 276 may be located at positions corresponding to the through holes 261 of the moving guide cove 260 illustrated in FIG. 9. The moving guide cover 260 and the first upper case 270 may be coupled to each other by inserting the coupling members 173 through the through holes 275 and 261. The through holes 276 forming the rectangular shape may be located at positions corresponding to the through holes 294 illustrated in FIG. 11A. The first upper case 270 and the second upper case 290 may be coupled to each other by inserting the coupling members 276 through the through holes 276 and 294.

Figure 12:
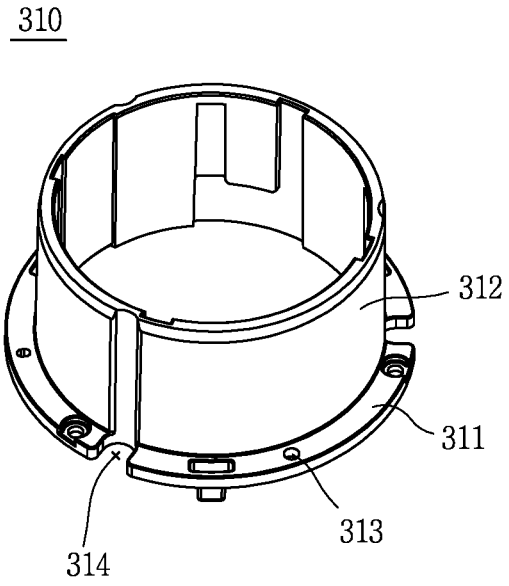
FIG. 12 is a perspective view of a sliding guide in accordance with the one embodiment of the present invention.

That is, the second upper case 290 may include a first barrier wall 291 formed at an inner side thereof in a cylindrical shape, a second barrier wall 292 outwardly spaced apart from the first barrier wall 291 by a predetermined gap and formed in parallel to the first barrier wall 291, and a bent portion 293 connecting the first and second barrier walls 291 and 292. The bent portion 293 may be provided with screw holes 294 to fix the coupling members 173. As illustrated in FIG. 11C, the second upper case 290 may be provided with a guide groove 295 formed by the first barrier wall 291 and the second barrier wall 292. A sliding guide 310 (see FIGS. 3 and 12) may be inserted in or drawn out of the guide groove 295 in response to switching of the first state and the second state. In more detail, a wall portion 312 of the sliding guide 310 illustrated in FIG. 12 may be fixed and induce a movement of the guide groove 295 of the second upper case 290.

A protruding portion 297 may be formed in the second upper case 290 and brought into contact with a lower surface (or lower portion) of the first speaker module 280. A plunger 298 may downwardly extend from the second upper case 290 at an opposite surface to the protruding portion 297. A recess 282 which is upwardly recessed into a lower surface of the first speaker module 280, a buffer member 161 (see FIGS. 2A and 3) may be provided in the recess 282 so as to reduce an impact between the protruding portion 297 and the first speaker module 280. That is, the buffer member 261 may be a speaker cushion.

Referring to FIG. 2A, a conveying device 300 may be provided below the second upper case 290. The conveying device 300 may include a first elastic member 330 which is provided at a central portion thereof and at which the plunger 298 is located, a pair of damping gears 320 provided at a side of the first elastic member 330, and a latch plate 350 having a pair of rack gears 351 upwardly protruding therefrom to be engaged with the pair of damping gears 320. The damping gear 320 may function to block a restoring force by the first elastic member 330. Also, the damping gear 320 may be filled with oil therein and function to reduce a rising speed of the second upper case 290, caused by the restoring force of the first elastic member 330, by use of oil pressure. Therefore, the damping gear 320 may also be called an oil pressure gear.

Figure 5:
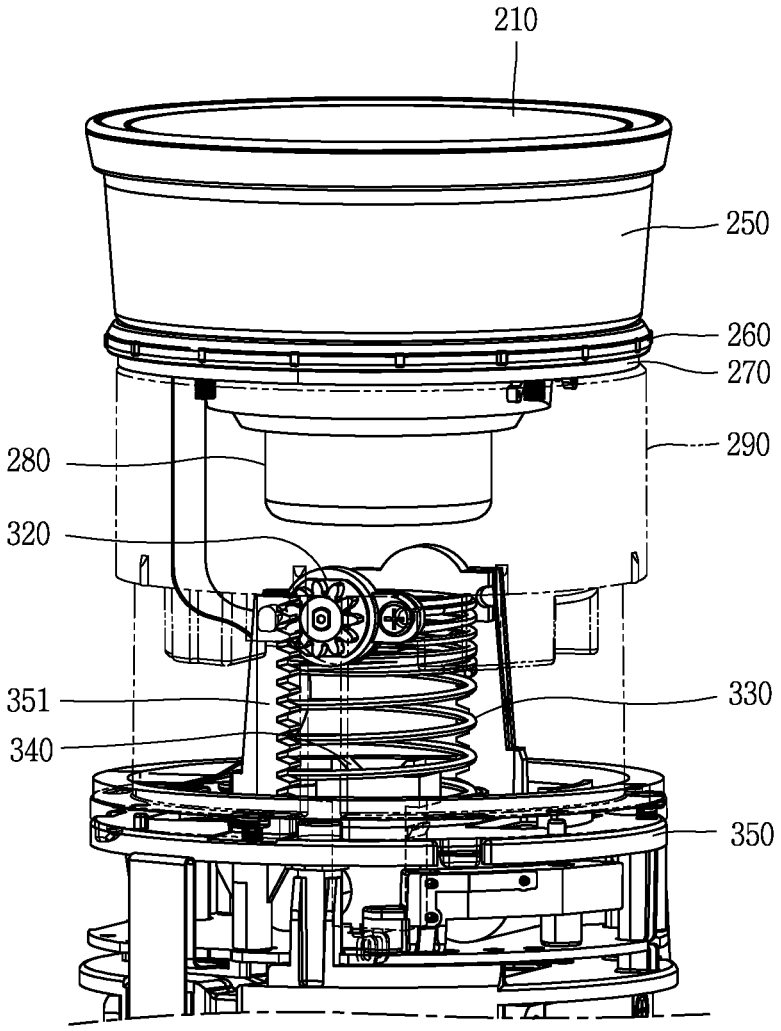
FIG. 5 is a partial perspective view of the sound output apparatus for explaining an operating mechanism of a conveying device in accordance with the one exemplary embodiment of the present invention.
Figure 13:
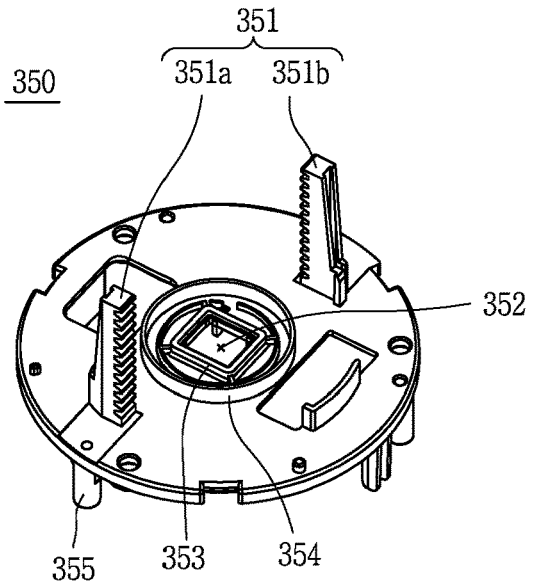
FIG. 13 is a perspective view of a latch plate in accordance with the one embodiment of the present invention.
Figure 20A:
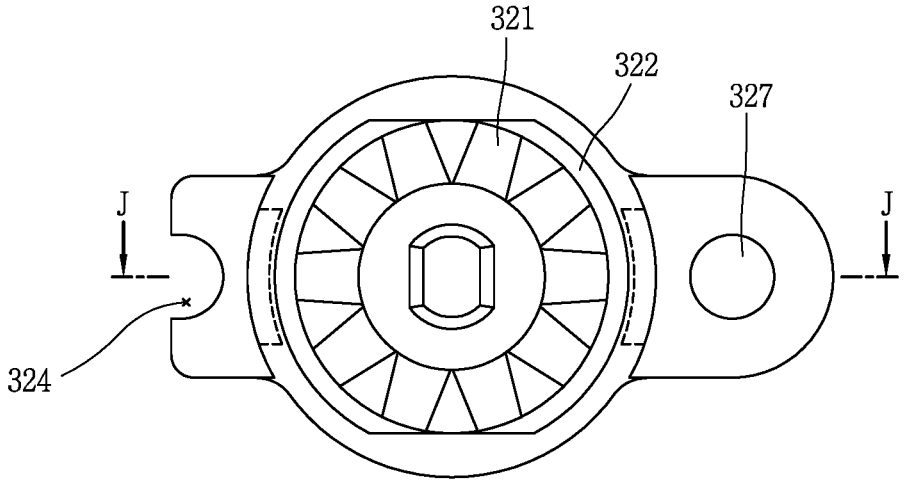
FIG. 20A is a plan view of a damping gear in accordance with the one embodiment of the present invention.
Figure 20B:
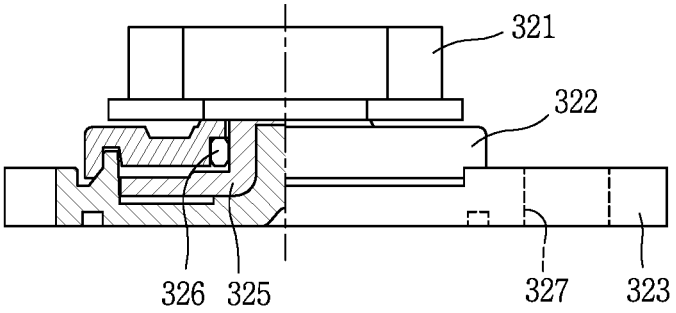
FIG. 20B is a sectional view taken along the line J-J of FIG. 20A.

FIG. 5 is a partial perspective view of the sound output apparatus for explaining an operating mechanism of the conveying device in accordance with the one exemplary embodiment of the present invention, FIG. 13 is a perspective view of the latch plate in accordance with the one embodiment of the present invention, FIG. 20A is a plan view of the damping gear in accordance with one embodiment of the present invention, and FIG. 20B is a sectional view taken along the line J-J of FIG. 20A.

Each of the pair of damping gears 320 may include a gear 321 rotating with coming in contact directly with the rack gear 351, and a body 322 disposed at one side of the gear 321 and filled therein with an o-ring 326. A coupling hole 327 may be formed at one end portion of the body 322, such that the coupling member 174 (see FIG. 3) can be inserted therethrough to couple the damping gear 320 to the second upper case 290. A recess 324 may be formed at another end portion of the body 322 such that the damping gear 320 can be held on the second upper case 290. That is, as the damping gear 320 coupled to the second upper case 290 is rotated with being engaged with the rack gear 351, sudden rising of the second upper case 290 due to the first elastic member 330 can be minimized. Also, a cover 323 may be coupled to the body 322 to close an inside of the body 322, and a rotary 325 may be provided in the body 322.

In more detail, the first elastic member 330 may be brought into contact with a lower surface of the second upper case 290 so as to apply a restoring force for pushing the second upper case 290 up. If the first sound output unit 200 is suddenly pushed up by an elastic force of the first elastic member 330, an impact may be likely to be applied to the first sound output unit 200. Accordingly, it may be preferable to make the first sound output unit 200 slowly moved upward. To this end, in the one embodiment of the present invention, the damping gear 320 may be engaged with the rack gear 351 to prevent the elastic force applied by the first elastic member 330, such that the first sound output unit 200 can be slowly moved upward. The damping gear 320 may be located on the latch plate 350 a disk-like plate, and provided as a pair.

Referring to FIGS. 2A and 13, a latch switch 340 may be provided at a position corresponding to a central portion of the first elastic member 330. A through hole 352 may be formed through a central portion of the latch plate 350. An inner rib 353 may be formed at a periphery of the through hole 352 to be higher than the through hole 352. The latch switch 340 may be stopped (locked) at the inner rib 353. The inner rib 353 may have a shape corresponding to a cross-section of the latch switch 340, and the one embodiment of the present invention exemplarily illustrates an approximately rectangular shape. An outer rib 354 formed in a circular shape may be formed at an outer side of the inner rib 353. The first elastic member 330 may be installed between the inner rib 353 and the outer rib 354. In this instance, the outer rib 354 may be higher than the inner rib 353.

Meanwhile, in the one embodiment of the present invention, when the decoration plate 210 is pushed, the sound output apparatus may be switched from the first state into the second state. When the decoration plate 210 is pushed again, the sound output apparatus may be switched from the second state back into the first state. To this end, the sound output apparatus 100 according to the one embodiment of the present invention may employ the latch switch 340.

Figure 19A:
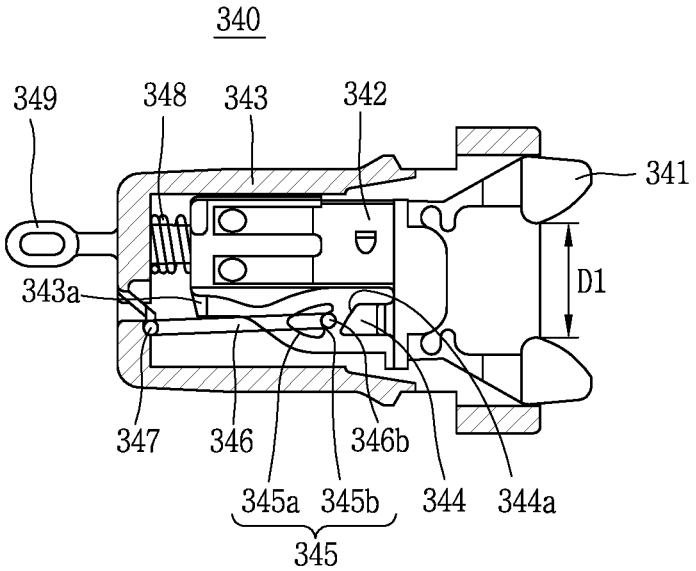
FIGS. 19A to 19D are views illustrating an operating mechanism of a latch switch in accordance with the one embodiment of the present invention.
Figure 19B:
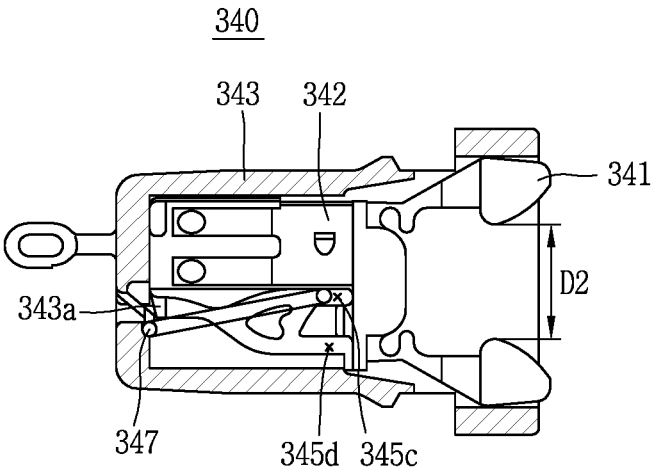
Figure 19C:
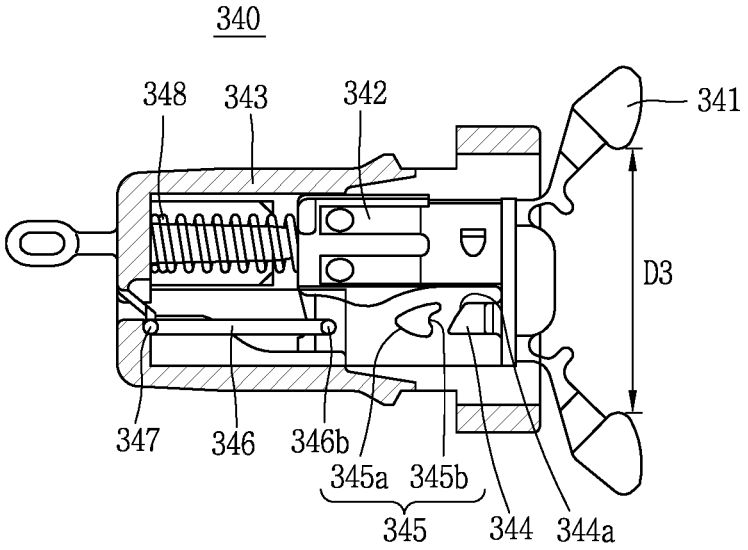
Figure 19D:
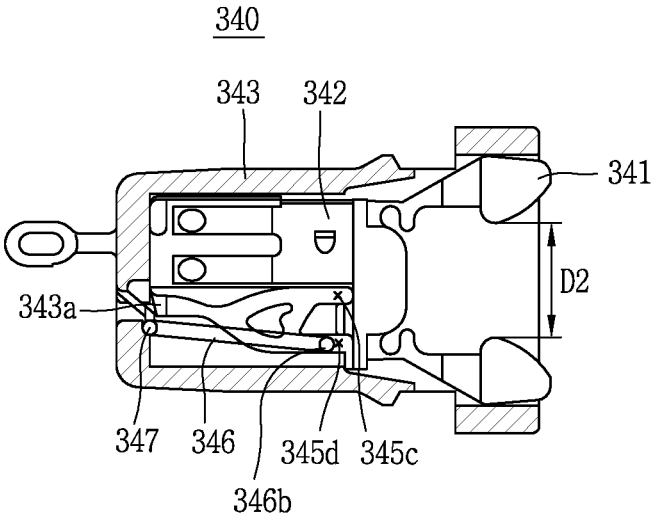

FIGS. 19A to 19D are views illustrating an operating mechanism of the latch switch 340 in accordance with one embodiment of the present invention. FIG. 19A illustrates the latch switch 340 in the first state, FIG. 19B illustrates the latch switch 340 when operated by an over stroke, FIG. 19C illustrates the latch switch 340 in the second state, and FIG. 19D illustrates the latch switch 340 during switching from the second state into the first state.

Hereinafter, a structure and an operation mechanism of the latch switch 340 will be described with reference to FIGS. 19A to 19D.

The latch switch 340 may include latches 341 each rotatable centering on one end portion thereof, a latch body 342 coupled to a lower portion of each latch 341, and a latch case 343 covering the latch body 342. A distance between end portions of the latches 341 may be decreased as the latch body 342 is inserted into the latch case 343. The distance between the end portions of the latches 341 may be increased as the latch body 342 is drawn out of the latch case 343. That is, one end portion of each latch 341 may be coupled to the latch body 342 and another end portion may be free. The distance between the another end portions of the latches 341 may vary according to a moved state of the latches 341.

In this instance, a distance between the end portions (free end portions) of the latches 341 in the first state may be D1, a distance between the end portions of the latches 341 in an over stroke state may be D2, and a distance between the end portions of the latch 341 in the second state may be D3.

Also, a second elastic member 348 which applies an elastic force to the latch body 342 may be provided at a lower portion of the latch body 342 in a manner of coming in contact with a bottom surface of the latch case 343. When an external force pressing the latches 341 and the latch body 342 is removed, the latch body 342 may automatically be moved upward by the second elastic member 348. A cross section of the latches 341 in the first state may have a shape corresponding to a protruded shape of the plunger 298. In the first state, when the decoration plate 210 is pressed down, the plunger 298 may be moved down accordingly. The plunger 298 may be brought into contact with a top of the latch body 342 and an inner side surface of the latch 341. When the plunger 348 further presses the latch 341 downward in the contact state with the inner side surface of the latch 341, an over stroke of the latch 341 may be caused. Accordingly, a lower end of the latch body 342 may be moved to a position of being almost brought into contact with the bottom surface of the latch case 343.

In this instance, a guide lever 346 may be provided in a manner of protruding from the bottom surface of the latch case 343 toward the latch 341. During the stroke of the latch 341, spaces 345*c* and 345*d* in which the guide lever 346 is receivable may be formed between the latch body 342 and the latch case 343. For example, path dividing portions 344 and 345 may be provided below the latch 341 so as to protrude to divide the receivable spaces for the guide lever 346. At least two paths 345*c* and 345*d* may be formed by the path dividing portions 344 and 345. During the stroke of the latch 341, the guide lever 346 may be selectively received in the first path 345*c* or the second path 345*d*.

The path dividing portions 344 and 345 may include a first path dividing portion 344 located at an upper side of the latch body 342 and inclined in one direction, and a second path dividing portion 345 formed at the latch body 342 with being spaced apart from the first path dividing portion 344. The second path dividing portion 345 may include a portion 345*a* facing the guide lever 346 and having a convex shape, and an opposite portion 345*b* to the portion 345*a* and having a concave shape. The second path dividing portion 345 may thusly have a shape like a heart.

Hereinafter, an operation mechanism of the latch switch 340 in the first state and the second state will be described.

One end portion of the guide lever 346 may be rotatably coupled to the lower surface of the latch case 343, and another end portion thereof may be bent into a shape like an alphabet 'L'. The bent portion 345*b* may be stopped at the second path dividing portion 345.

First, as illustrated in FIG. 19A, in the first state, the latch body 342 may be received in the latch case 343 and the second elastic member 348 may be compressed accordingly. The second path dividing portion 345 may be fixed by the guide lever 346 so as to prevent the latch body 342 from being moved upward. In this instance, as illustrated in FIG. 19B, when the plunger 298 presses the inner side surface of the latch 341, the latch body 342 may be moved down so as to more press the second elastic member 348. The another end portion 346*b* of the guide lever 346 may accordingly be separated from the second path dividing portion 345, and thus be located in the first path 345*c* by the first path dividing portion 344 which is spaced apart from the second path dividing portion 345. That is, the first path dividing portion 344 may push the free end 346*b* of the guide lever 345 toward the latch body 342. Afterwards, when an external force pressing the latch 341 is removed, as illustrated in FIG. 19C, the latch body 342 may be moved up and accordingly the guide lever 346 may be gradually moved away from the latch body 342 due to a protrusion 343*a*, which is provided at one side of the lower end of the latch body 342. Also, the guide lever 346 may be spaced apart from the latch body 342 with a predetermined interval due to the protrusion 343*a*. Consequently, the second state can be implemented. During this process, the moving speed of the latch body 342 may be decreased by the damping gears 320, accordingly the latch body 342 may be slowly moved up.

Afterwards, when the latch 341 is pressed again, it should be converted back into the first state, which will be described with reference to FIG. 19D. When the latch 341 is pressed in the second state illustrated in FIG. 19C, the second path dividing portion 345 may be brought into contact with the free end 346*b* of the guide lever 346 earlier than the first path dividing portion 344. Since the second path dividing portion 345 has the convex shape toward the guide lever 346, the second path dividing portion 345 may push the guide lever 346 to one side during contact with the guide lever 346. In this instance, the guide lever 346 may be accommodated in the second path 345*d*, different from the first path 345*c*. When the latch 341 is continuously pressed while the guide lever 346 is located in the second path 345*d*, an over stroke may be caused. In this instance, when an external force applied to the latch 341 is removed, the latch 341 and the latch body 342 may be moved up by the second elastic member 348. The free end 346*b* of the guide lever 346 may also be mounted on the concave portion 345*b* of the second path dividing portion 345, thereby preventing the movement of the latch body 342. This may result in the conversion back into the first state The through hole 352 (see FIG. 13) in which the latch switch 340 can be accommodated may be formed through the center of the latch plate 350, and the pair of rack gears 351 may be provided in an upward direction at the periphery of the latch switch 340. In this instance, the rack gears 351 may be arranged in a clockwise or counterclockwise direction. That is, in order for the first sound output unit 200 to be moved up and down in a balanced state, the rack gears 351 may be formed to be a point-symmetric based on the center of the latch plate 350, in other words, the formation positions of the rack gears 351 may be symmetric with each other based on the center of the latch plate 350.

Referring to FIG. 3, a main printed circuit board 360 may be provided beneath the latch plate 350, and a plurality of electronic components may be mounted on the main printed circuit board 360. The main printed circuit board 360 and the touch printed circuit board 230 may be connected to each other via a flexible printed circuit board 131 or a flexible cable. A plurality of bosses 355 may be formed at a lower portion of the latch plate 350, and coupling members 177 may be inserted into the bosses 355 via the lower portion of the main printed circuit board 360. Accordingly, the main printed circuit board 360 and the latch plate 350 can be coupled to each other.

The lower cases 410 and 420 may be provided at a lower portion of the latch plate 350. A plurality of grooves 361 may be formed at an outer periphery of the main printed circuit board 360 and a plurality of bosses 412 may be formed upwardly at an upper surface of the lower case 410. Accordingly, the bosses 412 may be located at positions corresponding to the grooves 361, thereby fixing the main printed circuit board 360.

Figure 14:
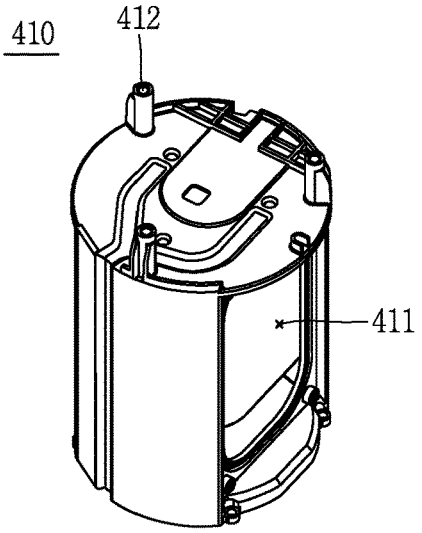
FIG. 14 is a perspective view of a first lower case in accordance with the one embodiment of the present invention.
Figure 15:
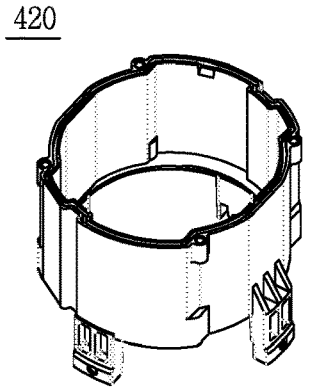
FIG. 15 is a perspective view of a second lower case in accordance with the one embodiment of the present invention.

FIG. 14 is a perspective view of a first lower case in accordance with the one embodiment of the present invention, and FIG. 15 is a perspective view of a second lower case in accordance with the one embodiment of the present invention.

The lower cases 410 and 420 according to one embodiment of the present invention may be in a cylindrical shape, and include a first lower case 410 provided at an upper side and a second lower case 420 coupled to a lower portion of the first lower case 410. The first lower case 410 and the second lower case 420 may have a hollow portion therein, and a second speaker module 490 may be provided in the hollow portion. The second speaker module 490 may be formed in an opposite direction to the first speaker module 280. That is, sounds generated by the second speaker module 490 may be emitted downward to outside. In this instance, the first lower case 410 may have a closed top and an open bottom. A through hole 411 may be formed through an outer circumferential surface of the first lower case 410. Vibration members 530 may be provided as a pair in the through hole 411 in a manner of facing each other. The through hole 411 may be closed by the vibration members 530, and a third sound output unit 500 may thusly be formed by the vibration members 530.

Meanwhile, the first sound output unit 200 and the second sound output unit 400 may be an active speaker or a powered speaker in which a sound amplifier is provided, but the third sound output unit 500 may be a passive speaker without the sound amplifier. The third sound output unit 500 according to the one embodiment of the present invention may not separately receive power supplied from outside for generating sound pressure. Therefore, a method of generating sound pressure for forming the third sound output unit 500 may be required. In the one embodiment of the present invention, vibration of the second sound output unit 400 is used to generate the sound pressure of the third sound output unit 500. That is, the second sound output unit 400 may be provided with a vibration plate 491 vibrating up and down. If it is assumed that the vibration plate 491 is in a state of plus (+) sound pressure when it is convex downwardly, and in a state of minus (−) sound pressure when it is convex upwardly, the third sound output unit 500 may recognize the (−) sound pressure state of the vibration plate 491 of the second sound output unit 400 as (+) sound pressure, and the (+) sound pressure state of the vibration plate 491 of the second sound output unit 400 as (−) sound pressure. To generate such sound pressure, the vibration member 530 may have a frame structure in an approximately rectangular shape.

The second sound output unit 400 may include the second speaker module 490. The vibration plate 491 may be disposed at a lower portion of the second speaker module 490 and sound holes 492 at an upper portion of the second speaker module 490. In this instance, sounds may be output to a front side of the vibration plate 491 due to the vibration of the vibration plate 491. However, the sound pressure may also be generated as the vibration of the vibration plate 491 is transferred even to a rear surface of the second speaker module 490. A difference of sound pressure generated from the rear surface of the second speaker module 490 may be transferred to the vibration members 530. Also, the vibration members 530 may vibrate back and forth so as to generate the difference of sound pressure. The thusly-generated sounds may be output to the outside of the vibration members 530, transferred between the external case 101 and the inner case, and then output to the outside through the sound holes 103 formed at the lower portion of the external case 101. FIG. 2B illustrates a sound path L3 by the third sound output unit 500.

Figure 16A:
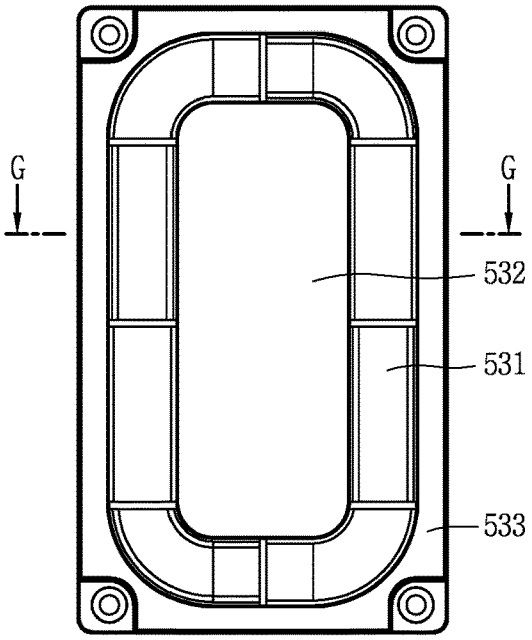
FIG. 16A is a plan view of a vibration member in accordance with the one embodiment of the present invention.
Figure 16B:
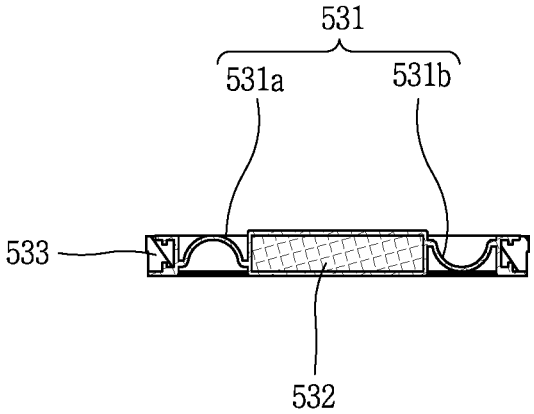
FIG. 16B is a sectional view taken along the line G-G of FIG. 16A.

FIG. 16A is a plan view of the vibration member in accordance with the one embodiment of the present invention, and FIG. 16B is a sectional view taken along the line G-G of FIG. 16A. As illustrated in FIGS. 16A and 16B, the vibration member 530 may include a rubber member 531 formed in an approximately rectangular frame shape, and a metal member 532 disposed in the rubber member 531. A frame 533 may be provided at an outer side of the rubber member 531 and coupled to the through hole 411 of the first lower case 410. The rubber member 531 may generate sounds by vibrating along with the metal member 532 like one vibration plate. The rubber member 531 may contain silicon, for example. The frame 533 may be coupled to the first lower case 410 by coupling members 181 (see FIG. 3). In this instance, the rubber member 531 may include first and second rubber members 531*a* and 531*b*, which are convex forwardly or backwardly. Here, the first and second rubber members 531*a* and 531*b* may be convex or concave in the same direction or different directions. That is, the first rubber member 531*a* may be convex toward the outside and the second rubber member 531*b* may be convex toward the inside. FIG. 16B illustrates that the first and second rubber members 531*a* and 531*b* are convex in the different directions.

Meanwhile, a second sound path generating unit 440 may be formed, similar to that in the first sound output unit 200, in order to emit sounds generated from the second sound output unit 400 in a downward direction. That is, the second lower case 420 may have upper and lower openings, and the second speaker module 490 may be accommodated in the second lower case 420. The second sound path generating unit 440 for extending a path L2 of sounds output from the second speaker module 490 to the outside may be formed at an end portion of the second speaker module 490.

Figure 17A:
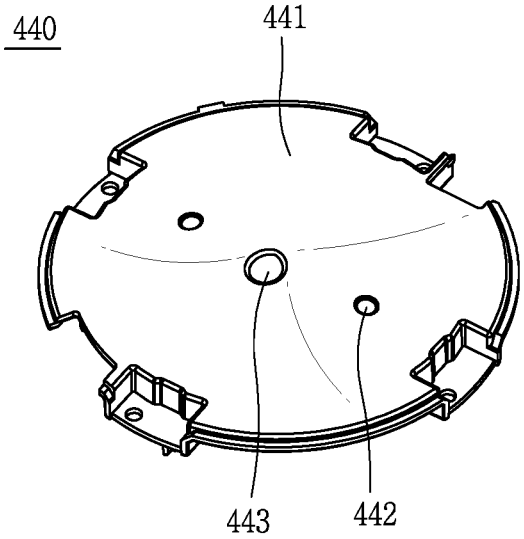
FIG. 17A is a perspective view of a second sound path generating unit in accordance with the one embodiment of the present invention.
Figure 17B:
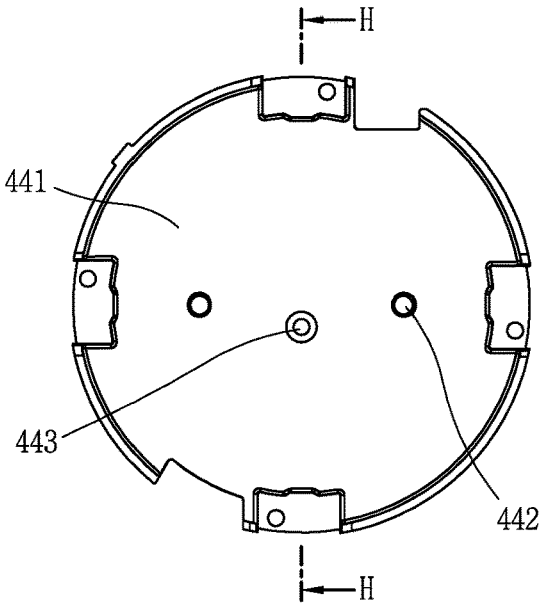
FIG. 17B is a planar view of FIG. 17A.
Figure 17C:
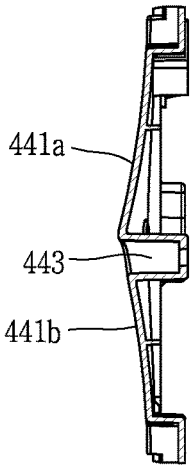
FIG. 17C is a sectional view taken along the line H-H of FIG. 17B.

FIG. 17A is a perspective view of the second sound path generating unit in accordance with the one embodiment of the present invention, FIG. 17B is a planar view of FIG. 17A, and FIG. 17C is a sectional view taken along the line H-H of FIG. 17B. As illustrated in FIGS. 17A to 17C, the second sound path generating unit 440 may have a convex shape toward the second speaker module 490, and be inclined downward from its center toward a lower portion. The sound path generating unit 440 may include inclined portions 441*a* and 441*b*. The inclined portions 441*a* and 441*b* may preferably be formed in a curved shape, other than a linear or flat shape, similar to the first sound generating unit 240.

Figure 18A:
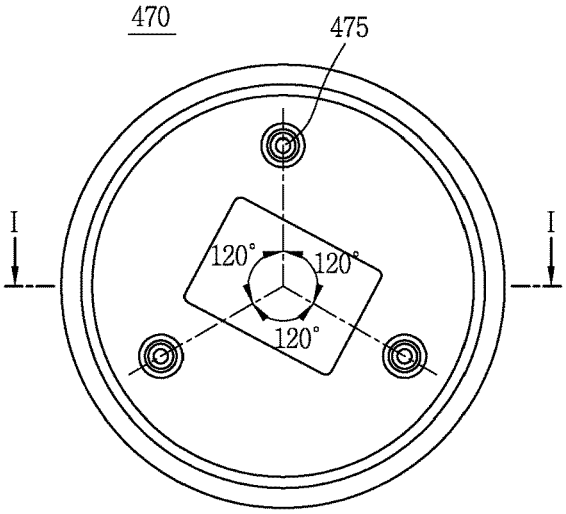
FIG. 18A is a plan view of a lower cap in accordance with the one embodiment of the present invention.
Figure 18B:
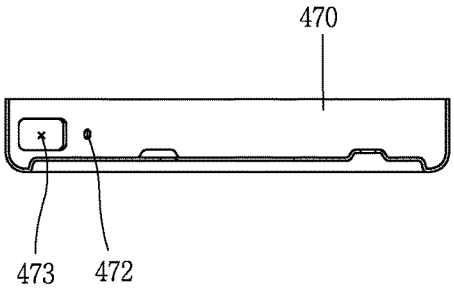
FIG. 18B is a sectional view taken along the line I-I of FIG. 18A.
Figure 18C:
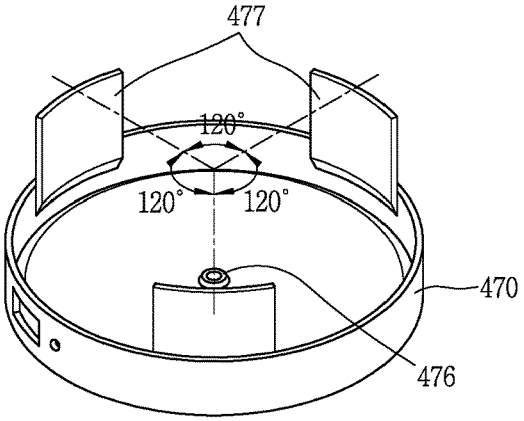
FIG. 18C is a perspective view of a lower cap in accordance with another embodiment of the present invention.

A sub printed circuit board 450 may be provided beneath the second sound path generating unit 440. The sub printed circuit board 450 may be electrically connected to the main printed circuit board 360, so as to control the second sound output unit 400. A printed circuit board fixing plate 460 for fixing the sub printed circuit board 450 may be provided beneath the sub printed circuit board 450, and accommodated in a lower cap 470. As illustrated in FIGS. 18A to 18C, the lower cap 470 may be provided to seal or cover a lower end portion of the sound output apparatus 100. A through hole 473 may be formed at one side surface of the lower cap 470, and an interface unit 104 may be inserted through the through hole 473. Also, the lower cap 470 may be provided with a small through hole 472, through which light emitted by an LED lens 471 may be leaked outward. In this instance, an example of the interface unit 104 may be a USB, and serve as a path for various types of external devices connected to the sound output apparatus 100. The interface unit 104, for example, may include any of wired or wireless ports, external power supply ports, wired or wireless data ports, memory card ports, ports for connecting a device having an identification module, audio input/output (I/O) ports, video I/O ports, earphone ports, and the like. In some cases, the sound output apparatus 100 may perform assorted control functions associated with a connected external device, in response to the external device being connected to the interface unit 104.

A through hole 443 may be formed through a center of the second sound path generating unit 440. The through hole 443 may communicate with a boss 461 (see FIG. 3) which is formed at a center of the printed circuit board fixing plate 460, such that a coupling member 183 can be inserted therethrough to couple the second sound path generating unit 440, the sub printed circuit board 450 and the printed circuit board fixing plate 460. Also, as illustrated in FIG. 18A, a plurality of bosses 475 may be formed at an inner surface of the lower cap 470, such that the lower cap 470 can be fixed to the printed circuit board fixing plate 460.

Also, a battery 495 may be disposed in the lower case 410, 420. The battery 495 may be formed long in up and down directions. The battery 495 and the sub printed circuit board 450 may be electrically connected by a power supply cable 133 or a wire. The main printed circuit board 360 may be electrically connected to the sub printed circuit board 450 by a flexible printed circuit board 132 or a flexible cable. Also, the main printed circuit board 360 may be electrically connected to the touch printed circuit board 230 by a flexible printed circuit board 131 or a flexible cable. With the configuration, the touch printed circuit board 230, the main printed circuit board 360 and the sub printed circuit board 450 may receive power supplied by the battery 495.

The foregoing description has been given of an example in which the sounds output by the first to third sound output units 200, 400 and 500 are output in all directions of 360°.

As illustrated in FIG. 1A, the sound holes 103 may be formed through the lower portion of the external case 101. Accordingly, sounds output by the second and third sound output units 400 and 500 may be output to the outside through the sound holes 103.

In this instance, output regions of the sounds output from the second and third sound output units 400 and 500 may be divided such that the output sounds can be more concentrated on specific regions. FIG. 18C is a perspective view of the lower cap 470 in accordance with the one embodiment of the present invention. Referring to FIG. 18C, the lower cap 470 may be dived into three regions. Also, ribs 477 protruding from the lower cap 470 may be disposed with a predetermined interval. The ribs 477 may obscure some of the sound holes 103 formed through the external case 101.

In this instance, if only a central portion 476 of the lower cap 470 is coupled to the printed circuit board fixing plate 460 and the lower cap 476 is allowed to be freely rotatable, a radiating direction of sounds which are externally output by the second and third sound output units 400 and 500 can be controlled. In this instance, the lower cap 470 can be rotated to facilitate the change of the sound output direction. FIG. 18C exemplarily illustrates that the ribs 477 are formed with an interval of 120° based on the center of the lower cap 470, but the present invention may not be necessarily limited to this.

Similar to this, in case of desiring to control a radiating direction of sounds which are externally output from the first sound output unit 200 to have a specific angle, it may be possible by sealing a partial region of the first sound output unit 250.

Meanwhile, the sound output apparatus 100 according to the one embodiment of the present invention may generate vibration at a plurality of points, and several components may be vulnerable to the generated vibration. To prevent this, buffer members 161, 162, 163, 164 and 165 may be disposed at positions where much vibration is caused in accordance with the one embodiment of the present invention. For example, the buffer member 165 may be disposed between the battery 495 and an inner side surface of the first lower case 410, the buffer member 163 may be disposed at an outer side surface of the second lower case 420, and the buffer member 162 may cover the vibration members 530 and an outer circumference of the first lower case 410. Those buffer members 161, 162, 163, 164 and 165 may be provided to reduce frictional noise generated due to friction among adjacent components and prevent a leakage of sounds to outside. Also, a wire attaching tape 166 for attaching the cable 133 and the like may be provided.

Hereinafter, an embodiment of using the sound output apparatus 100 according to the one embodiment of the present invention will be described.

The decoration plate 210 according to the one embodiment of the present invention may include various sound control indicators 211. Hereinafter, an embodiment of the sound output apparatus 100 will be described with reference to the related drawings.

First, the sound output apparatus 100 according to the one embodiment of the present invention should be paired with an electronic device which can be paired therewith through short-range communication. The pairing through the short-range communication may include pairing by the NFC 220 as well as pairing through BLUETOOTH™ and WiFi. When the decoration plate 210 is pressed, power may be supplied to the sound output apparatus 100 such that the sound output apparatus 100 can be converted from the first state into the second state, thereby immediately entering a pairing mode. When the sound output apparatus 100 enters the pairing mode, the lighting member 235 may be blinked two times for two seconds to notify the entrance to the user. When there is no electronic device to be paired near the sound output apparatus 100 for ten minutes after entering the pairing mode, the pairing mode may be deactivated. If there is an electronic device to be paired near the sound output apparatus 100, the sound output apparatus 100 may be generated in a list of pairable devices through BLUETOOTH™, which is provided in the electronic device. A password may be input into the electronic device, and the pairing between the sound output apparatus 100 and the electronic device may be carried out.

The pairing method may be easy pairing which is automatically executed at the same time when power is on. If it is assumed that the electronic device is a first electronic device, there may be a case of desiring to pair with a second electronic device, different from the first electronic device, or repair with an electronic device which has been paired before. In this instance, the electronic device which has been paired before may be the first electronic device.

In this instance, pairing should be executed in a manual manner. In more detail, after power is on by pressing the decoration plate 210, when a touch input is applied to a BLUETOOTH™ indicator 212 for a predetermined time, the sound output apparatus 100 may enter the pairing mode. In this instance, upon entering the pairing mode, as similar to the aforementioned, the BLUETOOTH™ indicator 212 may be blinked two times for two seconds and a list of pairable electronic devices may be output on the second electronic device or the electronic device which has been paired before. In this instance, pairing may be carried out by inputting a password into the second electronic device or the electronic device which has been paired before. The step of inputting the password may be omitted in some cases.

The foregoing description has been given based on the pairing mode through BLUETOOTH™, but the present invention may also be applied to pairing through WiFi, which will be described in detail hereinafter.

In addition, even pairing through NFC as well as the pairing through BLUETOOTH™ or WiFi may also be allowed, which will now be described in more detail. First, when an electronic device which can support NFC is brought into contact with the decoration plate 210 of the sound output apparatus 100, the electronic device may recognize the sound output apparatus 100 so as to be automatically paired with the sound output apparatus 100. Or, when pairing or non-pairing is inquired, the user can select 'Yes' to pair the sound output apparatus 100 and another electronic device with each other. After the sound output apparatus 100 and the another electronic device are paired through the NFC, the paired state may continuously be maintained while the electronic device is located at a region within a predetermined range from the sound output apparatus 100. Afterwards, when desiring to release the pairing, the electronic device may be moved away from the decoration plate 210 again, thereby releasing the pairing.

Figure 22:
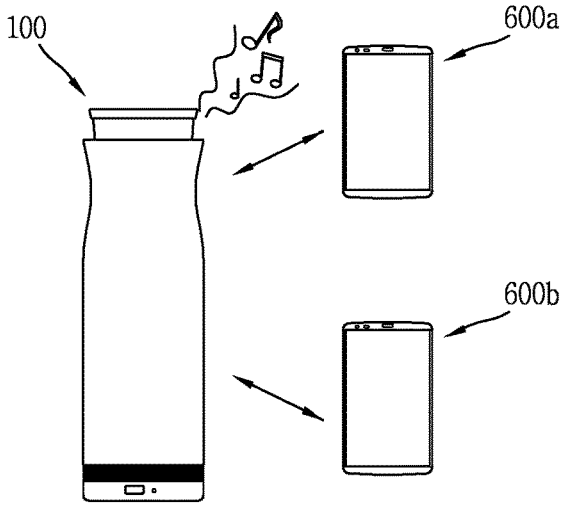
FIG. 22 is a view illustrating an example of using the sound output apparatus in accordance with the one embodiment of the present invention.

The sound output apparatus 100 according to the one embodiment of the present invention may be connected to two electronic devices at the same time. FIG. 22 is a view illustrating an example of using the sound output apparatus in accordance with the one embodiment of the present invention. Referring to FIG. 22, after paring with a first electronic device 600*a*, power of the sound output apparatus 100 may be blocked and then pairing with a second electronic device 600*b* may be carried out. In this instance, one of the first and second electronic devices 600*a* and 600*b* may be designated as a primary electronic device, and sounds may be output by the primary electronic device.

Figure 23:
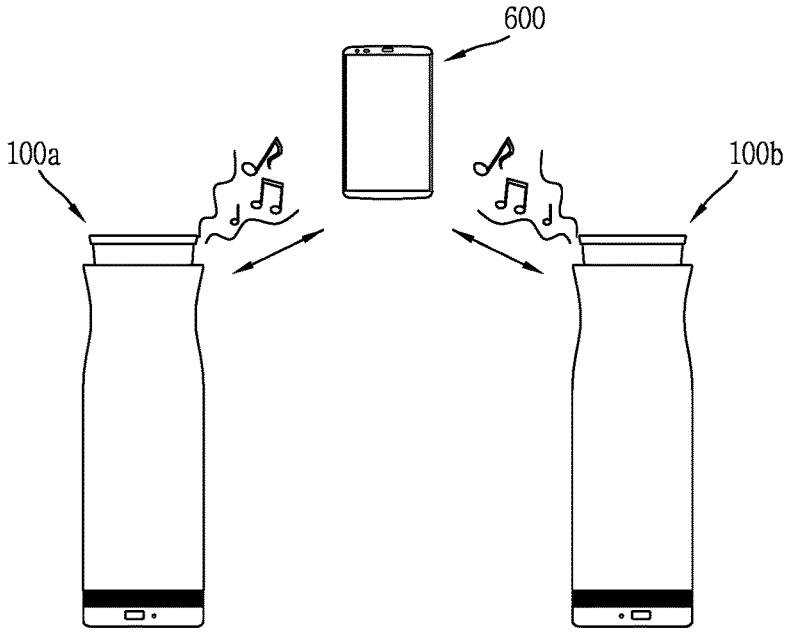
FIG. 23 is a view illustrating another example of using a sound output apparatus in accordance with the one embodiment of the present invention.

Meanwhile, FIG. 23 is a view illustrating another example of using the sound output apparatus in accordance with the one embodiment of the present invention. Referring to FIG. 23, stereoscopic sounds may be generated by using two sound output apparatuses 100 according to one embodiment of the present invention. That is, one electronic device 600 and two sound output apparatuses 100*a* and 100*b* may be paired (Dual play). For example, the first sound output apparatus 100*a* may first be paired with the electronic device 600. Afterwards, when the BLUETOOTH™ indicator 212 and a volume-down button 214*a* of the second sound output apparatus 100*b* are pressed for two seconds at the same time and the BLUETOOTH™ indicator 212 and a volume-up button 214*b* of the first sound output apparatus 100*a* are pressed for two seconds, the lighting member 235 may be blinked one time for two seconds. Afterwards, when desiring to stop the stereoscopic sound output, the BLUETOOTH™ indicator 212 and the volume-up button 214*a* of the first sound output apparatus 100*a* or the second sound output apparatus 100*b* may simultaneously be pressed or the BLUETOOTH™ indicator 212 and the volume-down button 214*b* may simultaneously be pressed for two seconds (long touch). For example, when the BLUETOOTH™ indicator 212 and the volume-up button 214*b* of the second sound output apparatus 100*b* are simultaneously pressed, the pairing between the second sound output apparatus 100*b* and the electronic device 600 may be released. The foregoing embodiment has illustrated the pairing using the volume-up button 214*a* or the volume-down button 214*b*, but the present invention may not be necessarily limited to this. The present invention may also be applied to execute the pairing using the BLUETOOTH™ indicator 212 and buttons 215*a*, 215*b* and 216 related to a reproduction speed.

Meanwhile, in the one embodiment of the present invention, various equalizer modes can be switched. For example, a first mode of a bass boost mode (low-band boost), a second mode of a treble boost mode (high-band boost) and a third mode of a power boost mode (full-band boost) may be switched. To this end, when an equalizer (EQ) button 213 of the sound control indicating unit 211 is touched (short touch), the lighting member 235 may be blinked one time in the first mode, two times in the second mode, and three times in the third mode. This may allow the user to recognize an activated mode.

In addition to the aforementioned buttons or indicators, the sound control indicating unit 211 may include buttons 215*a* and 215*b* moving to a previous/next sequence, a play/pause button 216, and a button 217 for controlling the lighting member 235. Those buttons may operate in a touch manner.

The present invention can be implemented as computer-readable codes in a program-recorded medium. The computer-readable medium may include all types of recording devices each storing data readable by a computer system. Examples of such computer-readable media may include hard disk drive (HDD), solid state disk (SSD), silicon disk drive (SDD), ROM, RAM, CD-ROM, magnetic tape, floppy disk, optical data storage element and the like. Also, the computer-readable medium may also be implemented as a format of carrier wave (e.g., transmission via an Internet). Therefore, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A sound output apparatus comprising:

an outer case having an upper portion with an opening oriented upward, and a lower portion with sound holes extending through the outer case;

a first sound output unit provided at an upper side within the outer case, the first sound output unit being configured to output sounds in a first frequency band;

a second sound output unit provided at a lower side within the outer case, the second output unit being configured to output sounds in a second frequency band; and a conveying device provided below the first sound output unit, the conveying device being configured to move the first sound output unit up and down with respect to the outer case, whereby, when the first sound output unit is moved up, the first sound output unit protrudes upward such that sounds are output between the outer case and the first sound output unit, wherein the first sound output unit includes:

a first speaker module configured to generate the sounds in the first frequency band;

a first upper case having a through hole provided at a central portion of the first upper case; and a second upper case connected to a lower portion of the first upper case, the second upper case defining an accommodation space for the first speaker module, wherein the conveying device is provided below the second upper case, and wherein the conveying device includes:

a first elastic member located on a plunger extending downward from the second upper case;

a pair of damping gears provided at one side of the first elastic member;

a latch plate having a through hole at a central portion of the latch plate and a pair of rack gears protruding upward from the latch plate, the pair of rack gears being coupled to the pair of damping gears; and a latch switch located at the through hole of the latch plate.

2. The sound output apparatus of claim 1, wherein the first sound output unit comprises:

a first sound path generating unit provided above the first speaker module, the first sound path generating unit being configured to reflect the sounds generated from the first speaker module in a lateral direction of the outer case; and a first sound transfer unit provided at an outer periphery of the first sound path generating unit, the first sound transfer unit being configured to output the sounds reflected from the first sound path generating unit to an exterior of the outer case.

3. The sound output apparatus of claim 1, the second upper case comprising:

a first wall having a cylindrical shape; and a second wall extending down from a top of the second upper case, the second wall extending along an outer surface of the first wall, wherein the first wall and the second wall define a guide groove therebetween.

4. The sound output apparatus of claim 3, further comprising a sliding guide at a lower portion of the second upper case, the sliding guide having a cylindrical shape and a wall portion protruding toward the guide groove, wherein the guide groove is displaceable up and down along the wall portion.

5. The sound output apparatus of claim 4, wherein the second upper case includes:

a protruding portion, the protruding portion being configured to be brought into contact with a lower portion of the first speaker module; and the plunger, the plunger being located opposite the protruding portion.

6. The sound output apparatus of claim 1, wherein the damping gears are coupled to the first wall of the second upper case.

7. The sound output apparatus of claim 1, wherein the pair of rack gears are point symmetric relative to a center of the latch plate.

8. The sound output apparatus of claim 2, wherein a lower surface of the first sound path generating unit includes a tilt portion, the tilt portion being upwardly tilted from a central portion of the first sound path generating unit to an outer surface of the first sound path generating unit.

9. The sound output apparatus of claim 2, wherein the first sound transfer unit comprises:

a first member having a cylindrical shape, the first member defining an outer surface of the first sound transfer unit;

a grille member located in the first member, the grille member being coupled to the first member by hooks; and a closure member provided along an outer surface of the first member.

10. The sound output apparatus of claim 1, wherein the second sound output unit comprises:

a second speaker module configured to generate the sounds in the second frequency band in a downward direction; and a second sound path generating unit provided below the second speaker module, the second sound path generating unit being configured to reflect the sounds generated from the second speaker module in a lateral direction of the outer case.

11. The sound output apparatus of claim 10, wherein the second sound path generating unit has a convex surface facing the second speaker module.

12. The sound output apparatus of claim 10, further comprising a lower case provided below the conveying device, the lower case being cylindrical, and the lower case including:

a first lower case; and a second lower case coupled to a lower portion of the first lower case, wherein the second speaker module is accommodated in a space defined by the first lower case and the second lower case.

13. The sound output apparatus of claim 12, wherein at least one through hole is formed through a side surface of the first lower case, wherein a vibration member is provided in the through hole, and wherein sounds in a third frequency band are output through the sound holes in the outer case in response to vibration of the vibration member caused by sounds output from a rear surface of the second speaker module.

14. The sound output apparatus of claim 13, wherein the vibration member comprises:

a rubber member having a rectangular perimeter, the rubber member including at least one of a convex portion or concave portion facing toward an exterior of the outer case;

a metal member provided at the rubber member to vibrate together with the rubber member; and a frame provided at an outer side of the rubber member, the frame being coupled to the first lower case.

15. The sound output apparatus of claim 10, further comprising:

a printed circuit board configured to control the second sound output unit, the printed circuit board being provided beneath the second sound path generating unit;

a fixing plate configured to fix the printed circuit board in the outer case, the fixing plated being provided beneath the printed circuit board; and a lower cap sealing a lower end portion of the outer case, the lower cap receiving the fixing plate.

16. The sound output apparatus of claim 15, wherein the lower cap includes ribs protruding from the lower cap at predetermined intervals, the ribs being displaceable into a position so as to obscure at least one of the sound holes.

17. The sound output apparatus of claim 16, wherein a central portion of the lower cap is rotatably coupled to the fixing plate.

18. The sound output apparatus of claim 16, wherein the predetermined interval is 120 degrees.

* * * * *